US006701106B2

(12) United States Patent
Yokoi et al.

(10) Patent No.: US 6,701,106 B2
(45) Date of Patent: Mar. 2, 2004

(54) CARTRIDGE HAVING DEVELOPER CONTAINING PORTION WITH INNER PRESSURE REGULATING FUNCTION

(75) Inventors: Akiyoshi Yokoi, Shizuoka (JP); Kazushi Watanabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/091,465

(22) Filed: Mar. 7, 2002

(65) Prior Publication Data

US 2002/0131789 A1 Sep. 19, 2002

(30) Foreign Application Priority Data

Mar. 9, 2001 (JP) ..... 2001/067378

(51) Int. Cl.[7] ..... G03G 15/00; G03G 15/08

(52) U.S. Cl. ..... 399/103; 399/93; 399/98; 399/111; 399/119

(58) Field of Search ..... 222/DIG. 1; 399/93, 399/98, 111, 119, 120, 103

(56) References Cited

U.S. PATENT DOCUMENTS

| | | | | |
|---|---|---|---|---|
| 5,095,335 | A | 3/1992 | Watanabe et al. | |
| 5,151,734 | A | 9/1992 | Tsuda et al. | |
| 5,208,634 | A | 5/1993 | Ikemoto et al. | |
| 5,223,893 | A | 6/1993 | Ikemoto et al. | |
| 5,294,960 | A | 3/1994 | Nomura et al. | |
| 5,331,372 | A | 7/1994 | Tsuda et al. | |
| 5,345,294 | A | 9/1994 | Nomura et al. | |
| 5,404,198 | A | 4/1995 | Noda et al. | |
| 5,463,446 | A | 10/1995 | Watanabe et al. | |
| 5,465,136 | A | 11/1995 | Watanabe et al. | 399/210 |
| 5,470,635 | A | 11/1995 | Shirai et al. | 428/131 |
| 5,475,470 | A | 12/1995 | Sasago et al. | |
| 5,488,459 | A | 1/1996 | Tsuda et al. | |
| 5,510,878 | A | 4/1996 | Noda et al. | |
| 5,561,504 | A | 10/1996 | Watanabe et al. | |
| 5,583,613 | A | 12/1996 | Kobayashi et al. | |
| 5,602,623 | A | 2/1997 | Nishibata et al. | 399/111 |
| 5,608,509 | A | 3/1997 | Shirai et al. | 399/351 |
| 5,640,650 | A | 6/1997 | Watanabe et al. | 399/117 |
| 5,659,847 | A | 8/1997 | Tsuda et al. | 399/113 |
| 5,669,042 | A | 9/1997 | Kobayashi et al. | 399/111 |
| 5,768,658 | A | 6/1998 | Watanabe et al. | 399/111 |
| 5,790,923 | A | 8/1998 | Oguma et al. | 399/106 |
| 5,794,101 | A | 8/1998 | Watanabe et al. | 399/103 |
| 5,809,374 | A | 9/1998 | Tsuda et al. | 399/111 |
| 5,828,928 | A | 10/1998 | Sasago et al. | 399/111 |
| 5,878,304 | A | 3/1999 | Watanabe et al. | 399/92 |
| 5,884,124 | A | 3/1999 | Karakama et al. | 399/123 |
| 5,887,227 | A * | 3/1999 | Kawai et al. | 399/98 |
| 5,903,803 | A | 5/1999 | Kawai et al. | 399/116 |
| 5,937,242 | A | 8/1999 | Yokoyama et al. | 399/114 |
| 5,940,658 | A | 8/1999 | Yokoi et al. | 399/119 |
| 5,966,568 | A | 10/1999 | Numagami et al. | 399/111 |

(List continued on next page.)

FOREIGN PATENT DOCUMENTS

| | | |
|---|---|---|
| JP | 9-236977 | 9/1997 |
| JP | 11-338234 | 12/1999 |
| JP | 2000-29296 | 1/2000 |

*Primary Examiner*—Hoang Ngo
(74) *Attorney, Agent, or Firm*—Fitzpatrick, Cella, Harper & Scinto

(57) ABSTRACT

A cartridge detachably mountable to an image forming apparatus, includes: a developer container; and a pressure regulating device for regulating the air pressure in the developer container. The pressure regulating device includes a hollow portion having a vent and an elastic filter being compressed into the hollow.

25 Claims, 22 Drawing Sheets

U.S. PATENT DOCUMENTS 6,006,058 A 12/1999 Watanabe et al. ..... 399/167
6,016,413 A 1/2000 Yokoyama et al. ..... 399/113
6,029,032 A 2/2000 Watanabe et al. ..... 399/111
6,070,028 A 5/2000 Odagawa et al. ..... 399/104
6,075,956 A 6/2000 Watanabe et al. ..... 399/92
6,097,908 A 8/2000 Uchiyama et al. ..... 399/111
6,097,909 A 8/2000 Watanabe et al. ..... 399/111
6,101,354 A 8/2000 Nakagawa et al. ..... 399/225
6,118,960 A 9/2000 Nakagawa et al. ..... 399/111
6,128,454 A 10/2000 Kawai et al. ..... 399/116
6,144,398 A 11/2000 Yokoyama et al. ..... 347/263
6,160,976 A 12/2000 Karakama et al. ..... 399/104
6,163,665 A 12/2000 Watanabe et al. ..... 399/111
6,169,866 B1 1/2001 Watanabe et al. ..... 399/111
6,175,706 B1 1/2001 Watanabe et al. ..... 399/167
6,226,478 B1 5/2001 Watanabe et al. ..... 399/117
6,236,821 B1 5/2001 Yokoyama et al. ..... 399/113
6,240,266 B1 5/2001 Watanabe et al. ..... 399/117
6,246,849 B1 6/2001 Yokoyama et al. ..... 399/117
6,253,036 B1 6/2001 Karakama et al. ..... 399/27
6,272,299 B1 8/2001 Numagami et al. ..... 399/111
6,324,363 B1 11/2001 Watanabe et al. ..... 399/111
6,330,402 B1 12/2001 Sakurai et al. ..... 399/12
6,330,409 B1 12/2001 Watanabe et al. ..... 399/111
6,336,018 B1 1/2002 Kawai et al. ..... 399/117
6,377,759 B1 4/2002 Abe et al. ..... 399/27

* cited by examiner

CARTRIDGE HAVING DEVELOPER CONTAINING PORTION WITH INNER PRESSURE REGULATING FUNCTION

BACKGROUND OF THE INVENTION

1. Field of the Invention

The present invention relates to a cartridge which is detachably mountable on an image forming apparatus such as a copying machine, a printer or the like using recording technologies such as electrophotographic recording, electrostatic recording and the like, and more particularly, to a cartridge which has a developer containing portion with an inner pressure regulating function.

2. Description of Related Art

Conventionally, a process cartridge system has been known in, e.g., an electrophotographic image forming apparatus. In the process cartridge system, a photosensitive member and a process means acting on the photosensitive member are integrally formed into a process cartridge, and the process cartridge is made detachably mountable on the main body of the image forming apparatus. According to such the process cartridge system, the image forming apparatus can be maintained by a user oneself without a serviceperson, whereby operability can be greatly improved. For this reason, the process cartridge system is widely used in the image forming apparatus.

In such the process cartridge, as shown in FIG. 17, a coupling member 11*e* is rotatably fit into a hole 11*e*1 of a lower frame 11*b* of a container-shaped toner frame 11, and the coupling member 11*e* has a circumferential groove 11*e*5. The coupling member 11*e* is prevented from coming off along the axial direction by a shaft snap ring 11*e*3 being fit into the groove 11*e*5. An arm 9*b*3 of a crank-shaped toner feed member 9*b* having a journal fit into a central hole 11*e*4 of the coupling member 11*e* is fitted into a slit 11*e*2 extending to the inner diameter of the coupling member 11*e*.

The coupling member 11*e* is shaft-sealed by a felt member 80 that is fitted into the hole 11*e*1, and air can go in and out the toner frame 11 through the felt member 80 because the felt member 80 is air permeable.

As shown in FIGS. 18A and 18B, a conventional toner cap 11-1*f* has circumferential protruded ridges 11-2*f* which can be force-fit into a toner filling opening 11-1*d* of the toner frame 11 as indicated by arrows E.

In a developing device which is detachably mountable on the main body of the image forming apparatus, a toner container containing a developer and a developing member (e.g., a developing sleeve) disposed at the opening of the toner container are integrally constituted, and the opening of the toner container is sealed with a toner seal until the developing device is actually used. When the developing device is used, the toner seal is removed, and the developing device is then mounted on the main body of the image forming apparatus.

However, airtightness between the inside and the outside of the container is improved in recently developed toner containers as compared with the formerly developed toner containers. Further, the toner particles have been made finer to cope with image enhancement, and toner filling has become dense to cope with ecological concerns and decrease in cost. For these reasons, seal performance for the toner container has become increasingly severe.

Therefore, to cope with such a situation, an oil seal is used as an agitating shaft seal member in a toner container having an agitating mechanism. Thus, air permeability at the agitating shaft portion decreases, whereby airtightness of the toner container surely improves. In this regard, e.g., Japanese Patent Application Laid-Open No. 9-236977 discloses the related art.

On the other hand, if the airtightness of the toner container is too high, there is the risk that when the cartridge receives a shock when the cartridge is in physical distribution or is used, the air pressure in the toner container rises too much in such a use environment of high temperature or the like, whereby the toner container deforms and the seal portion is damaged.

In order to solve such problems, the applicant has proposed the cartridge having the function to regulate the inner pressure of the toner container in Japanese Patent Application Laid-Open Nos. 11-338234 and 2000-29296.

In the pressure regulating mechanism as described in these documents, a vent is provided on the part of the toner container, the vent is covered by a sheet-shaped filter, and the filter is welded to the toner container. By such the mechanism, air permeability is permitted while preventing the toner from leaking, and the inner pressure of the toner container is regulated.

However, since it is necessary to prevent the toner from leaking, it takes time to weld or adhere the sheet-shaped filter to the container.

SUMMARY OF THE INVENTION

The present invention is accomplished in consideration of the above problem, and an object thereof is to provide a cartridge which can suppress an increase of an inner pressure of a developer container while maintaining a seal of the container.

Another object of the present invention is to provide a cartridge which can suppress an increase of an inner pressure of a developer container while maintaining a seal of the container in a simple way.

Still another object of the present invention is to provide a cartridge which can suppress an increase of an inner pressure of a developer container while maintaining a seal of the container, even if a filter disposed on a vent is not welded or adhered to the container.

Still another object of the present invention is to provide a cartridge comprising:

a developer container; and a pressure regulating means for regulating an air pressure in the developer container, the pressure regulating means including a hollow portion having a vent and an elastic filter being compressed into the hollow portion.

Still another object of the present invention is to provide a cartridge comprising:

a developer container, the developer container including a first frame and a second frame; and a pressure regulating means, provided on the second frame, for regulating an air pressure in the developer container, wherein the pressure regulating means includes a hollow portion having a vent and a filter being disposed in the hollow portion, and the first frame has a function to prevent the filter from coming off from the hollow portion.

Other objects of the present invention will become apparent by reading the following detailed description as referring to the attached drawings.

DETAILED DESCRIPTION OF THE PREFERRED EMBODIMENTS

Hereinafter, the embodiments of the present invention will be explained with reference to the accompanying drawings.

Embodiment 1

Figure 4:
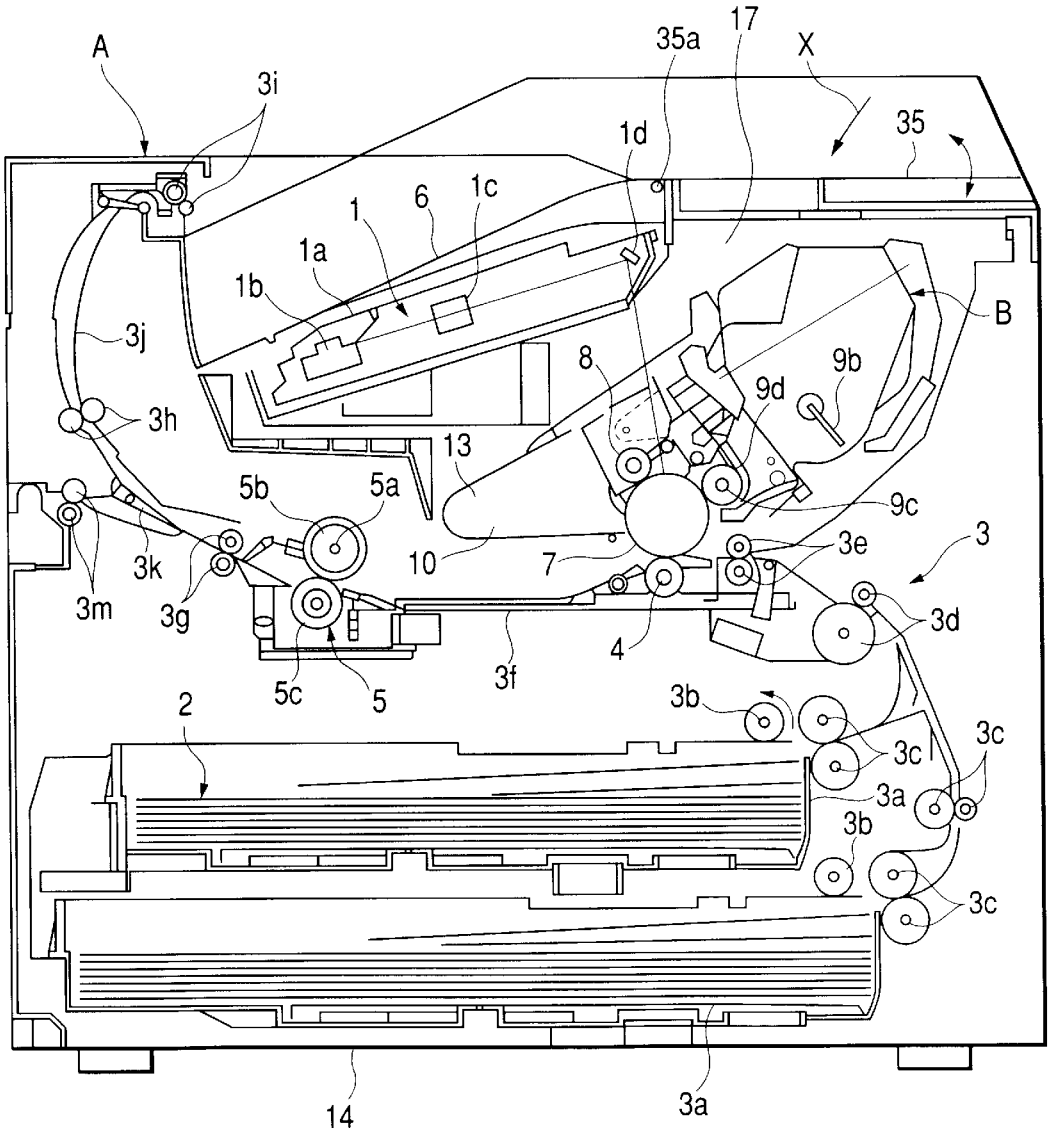
FIG. 4 is a vertical sectional schematic view showing the mechanism of an image forming apparatus.

In the following explanation, as shown in FIG. 4, the lateral (shorter-edge) direction of a process cartridge B corresponds to the direction in which the process cartridge B is detachably mounted on an image forming apparatus main body (simply called an apparatus main body hereinafter) 14 (i.e., the direction indicated by an arrow X and its opposite direction), and the lateral direction of the process cartridge B is approximately aligned with a recording material transporting direction. Moreover, the longitudinal (longer-edge) direction of the process cartridge B corresponds to the direction which intersects (approximately perpendicular to) the direction in which the process cartridge B is detachably mounted on the apparatus main body 14, parallels the surface of a recording material, and intersects (approximately perpendicular to) the recording material transporting direction. Moreover, the left and the right directions of the process cartridge B respectively correspond to the left and the right directions in the case where the recording material is seen from above along the recording material transporting direction.

Figure 1:
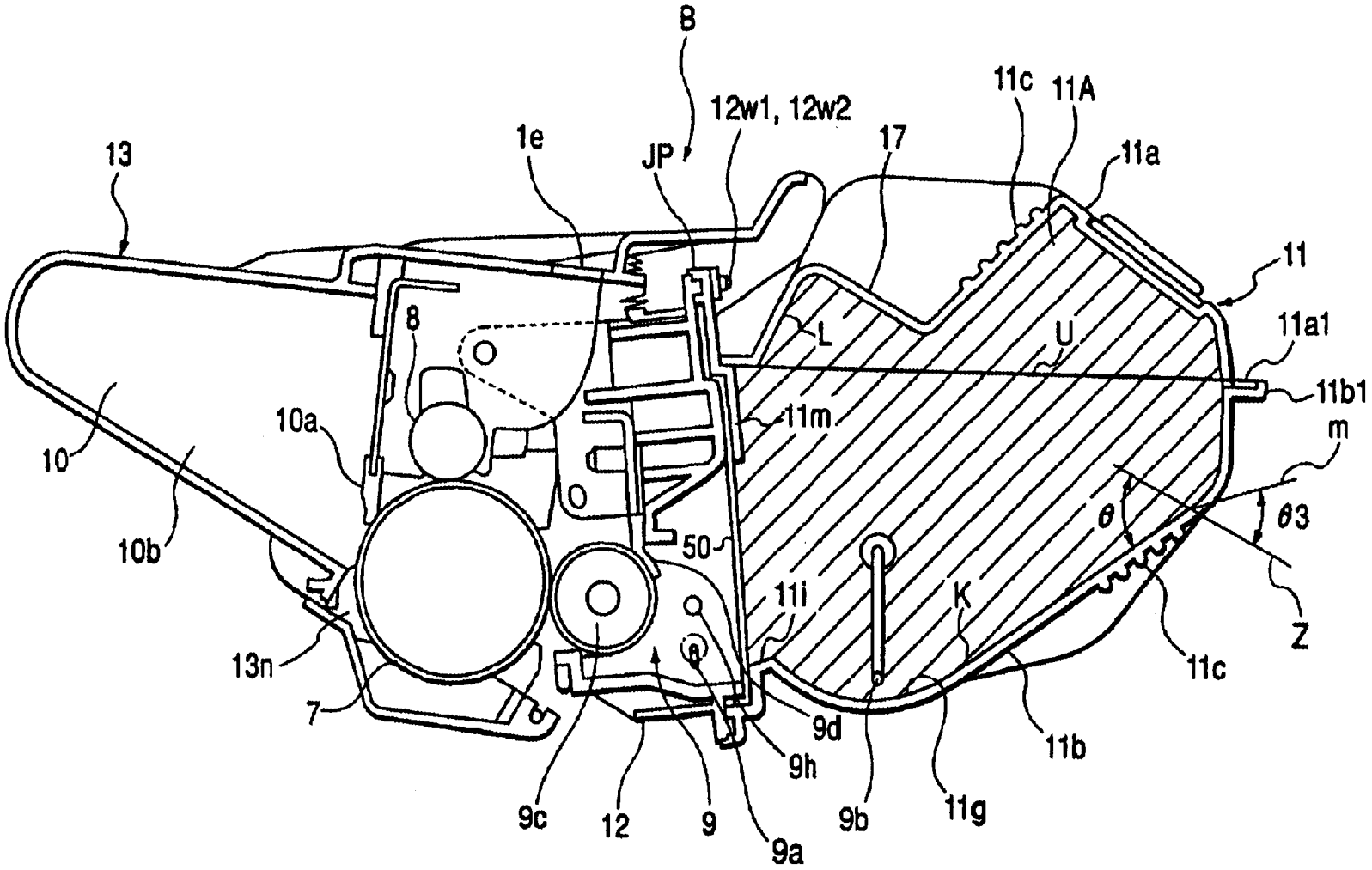
FIG. 1 is a vertical sectional view showing a process cartridge in a cleaner direction perpendicular to the longitudinal direction of the cartridge.
Figure 2:
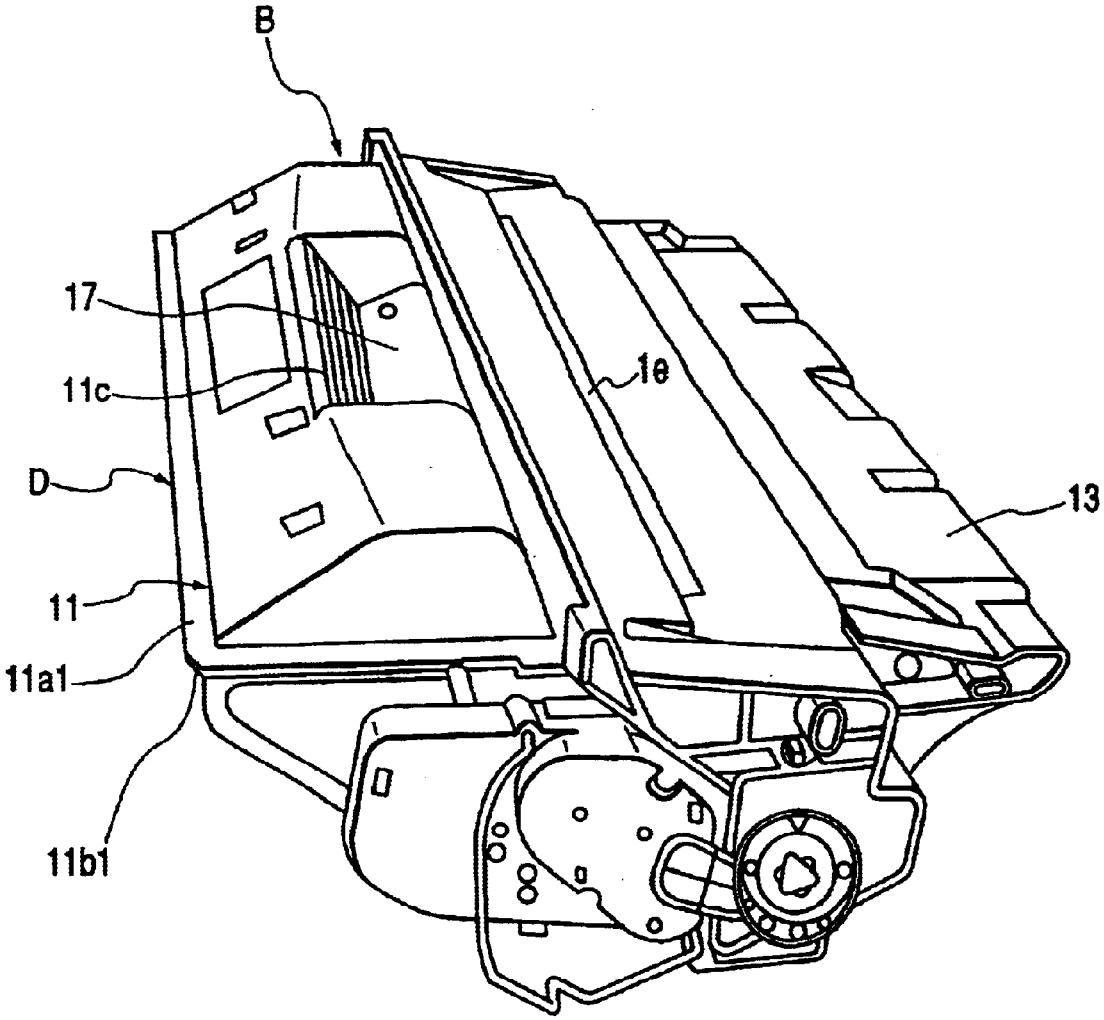
FIG. 2 is a perspective view showing the process cartridge.
Figure 5:
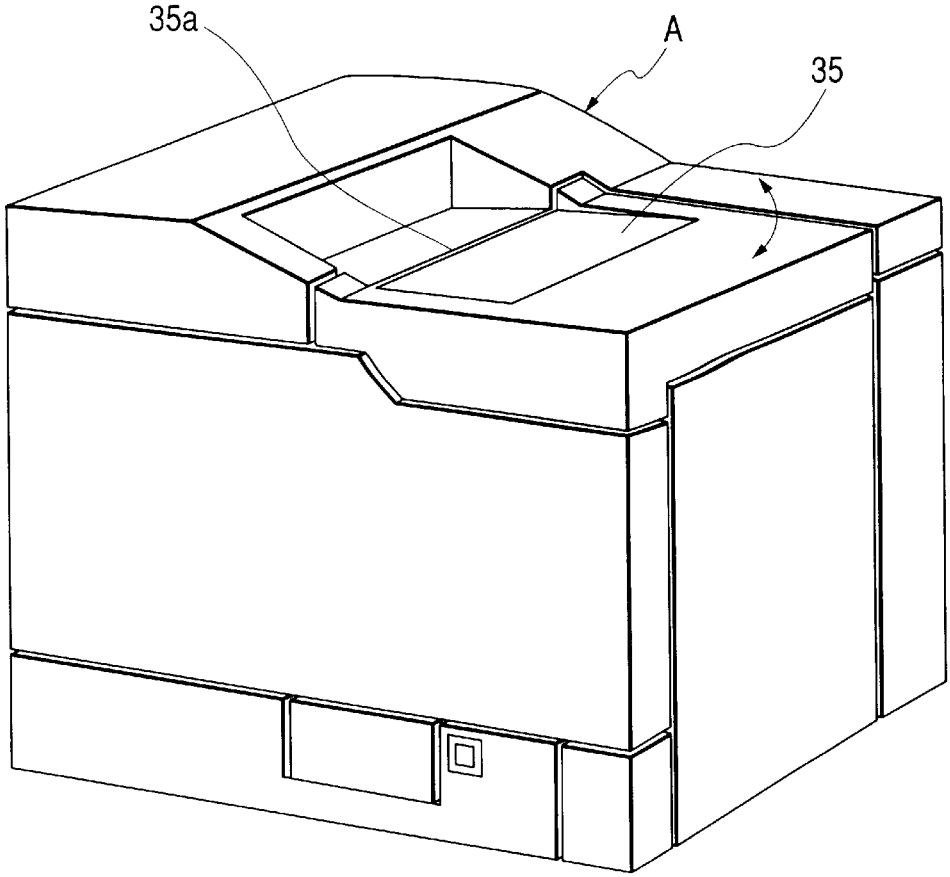
FIG. 5 is a perspective view showing the appearance of the image forming apparatus.
Figure 8:
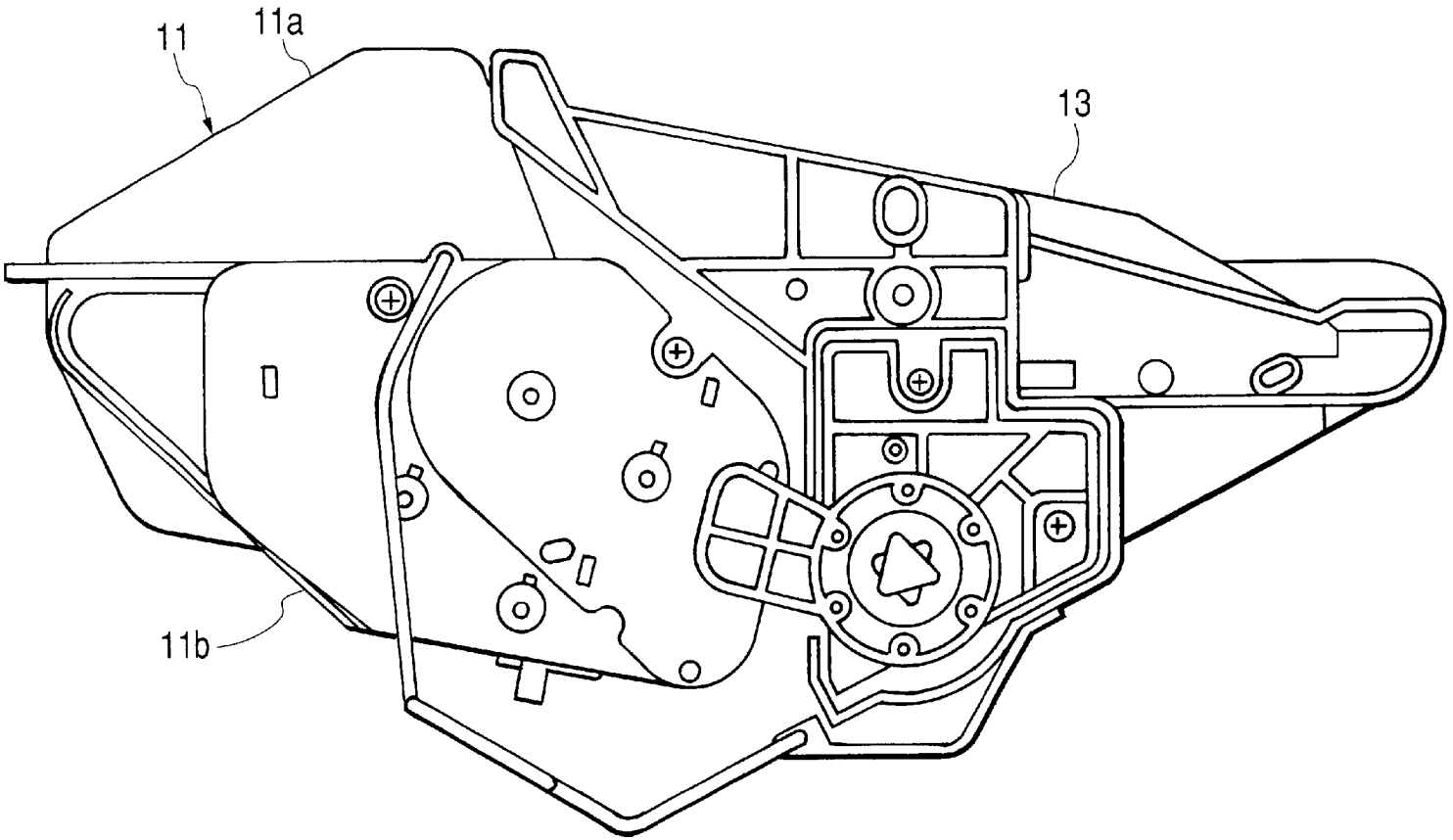
FIG. 8 is a right side view showing the process cartridge of FIG. 2, based on the mounting direction of the cartridge.
Figure 9:
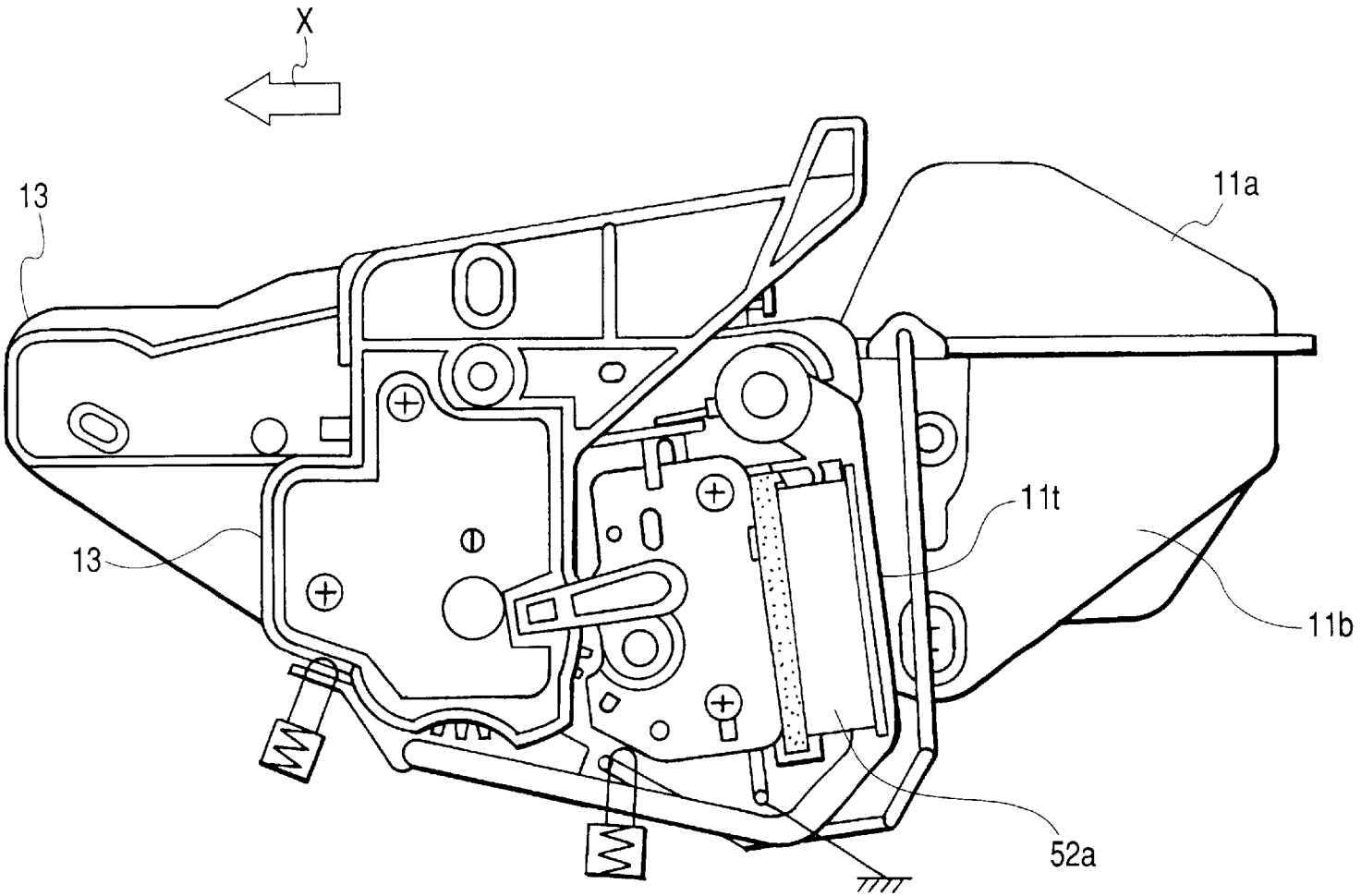
FIG. 9 is a left side view showing the process cartridge of FIG. 2, based on the mounting direction of the cartridge.
Figure 10:
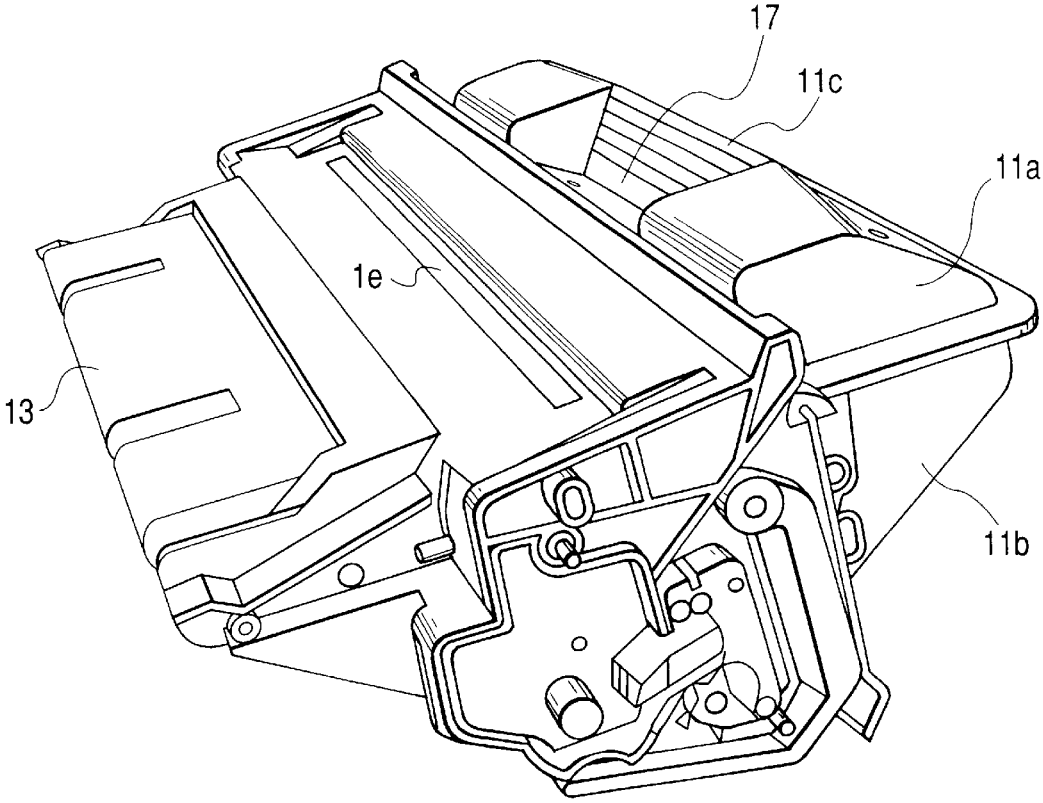
FIG. 10 is a perspective view showing the process cartridge of FIG. 2 as viewed from the above the cartridge to the left.
Figure 11:
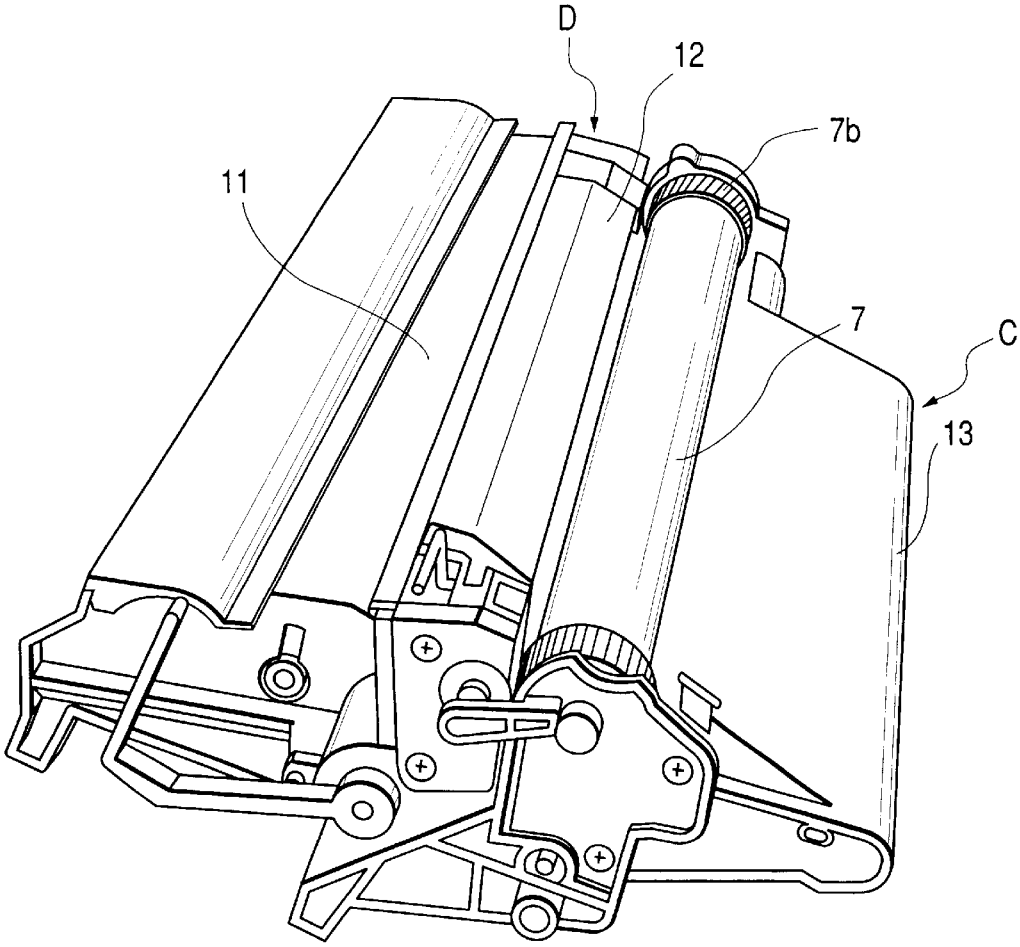
FIG. 11 is a perspective view showing the process cartridge of FIG. 2 as viewed from the below the cartridge to the left.

FIG. 4 is a schematic view for explaining the mechanism of an electrophotographic image forming apparatus (laser beam printer), and FIG. 5 is a perspective view showing the appearance of the image forming apparatus. Moreover, FIGS. 1 and 8 to 11 are views concerning the process cartridge to which the present invention is applied, that is, FIG. 1 is a side sectional view of the process cartridge, FIG. 2 is a perspective view of a schematic appearance of the process cartridge, FIG. 8 is a right side view of the process cartridge, FIG. 9 is a left side view of the process cartridge, FIG. 10 is a perspective view of the process cartridge as viewed from the upper side (top), and FIG. 11 is a perspective view of the process cartridge turned over and viewed from the upper side. Moreover, in the following explanation, the top of the process cartridge B corresponds to the face positioned above in the state that the process cartridge B is being mounted on the apparatus main body 14, while the bottom of the process cartridge B corresponds to the face positioned below.

Image Forming Apparatus A and Process Cartridge B

Initially, a laser beam printer A serving as the electrophotographic image forming apparatus will be explained with reference to FIGS. 4 and 5. Moreover, FIG. 1 is the side sectional view showing the process cartridge B.

As shown in FIG. 4, the laser beam printer A forms an image on a recording material (e.g., a recording sheet of paper, an OHP sheet, cloth or the like) in accordance with an electrophotographic image forming process. Then, a toner image is formed on a drum-shaped electrophotographic photosensitive member (called a photosensitive drum hereinafter) 7 as an image bearing member. Particularly, the photosensitive drum 7 is charged by a charging roller (charging means) 8, and successively a laser beam according to image information irradiates the photosensitive drum 7 by an exposing device (optical means) 1, whereby an electrostatic latent image according to the image information is formed on the photosensitive drum 7. Then, the formed electrostatic latent image is developed by a developing device (developing means), as a result a toner image is formed. In synchronism with such the toner image formation, a recording material 2 set in a feed cassette 3*a* is transported by a pickup roller 3*b*, a pair of transporting rollers 3*c*, a pair of transporting rollers 3*d* and a pair of registration rollers 3*e*.

Next, the toner image formed on the photosensitive drum 7 in the process cartridge B is transferred to the recording material 2 by applying voltage to a transferring roller 4 serving as a transferring means. After then, the recording material 2 to which the toner image has been transferred is transported to a fixing device (fixing means) 5 along a transporting guide 3*f*. The fixing device 5 consists of a driving roller 5*c* and a fixing roller 5*b* having a heater 5*a* therein, and the toner image transferred to the recording material 2 is fixed by applying heat and pressure to the recording material 2 passing between the rollers 5*c* and 5*b*. Then, the obtained recording material 2 is transported by a pair of delivery rollers 3*g*, a pair of delivery rollers 3*h* and a pair of delivery rollers 3*i*, and the recording material 2 is thus delivered to a delivery tray 6 through a surface reverse path 3*j*. The delivery tray 6 is provided on the top of the apparatus main body 14 of the image forming apparatus A. Incidentally, if a pivotable flapper 3*k* is operated, the recording material 2 can be also delivered by a pair of delivery rollers 3*m* without passing through the surface reverse path 3*j*.

In the present embodiment, a feeding and transporting means 3 consists of the pickup roller 3*b*, the pairs of transporting rollers 3*c* and 3*d*, the pair of registration rollers 3*e*, the transporting guide 3*f*, the pairs of delivery rollers 3*g*, 3*h* and 3*i*, the surface reverse path 3*j* and the pair of delivery rollers 3*m*.

On the other hand, as shown in FIG. 1, the photosensitive drum 7 included in the process cartridge B and having a photoconductive layer rotates, whereby the surface of the drum 7 is uniformly charged by applying voltage to the charging roller 8 serving as the charging means. Then, the laser beam according to the image information sent from the exposing device 1 irradiates to the photosensitive drum 7 through an exposing opening 1*e*, whereby the electrostatic latent image is formed on the photosensitive drum 7. The formed electrostatic latent image is developed by a developing device 9 with use of toner. Here, the charging roller 8 is in contact with the photosensitive drum 7 to charge the photosensitive drum 7, and the charging roller 8 rotates according to the photosensitive drum 7. Moreover, the developing device 9 supplies the toner to the developing area on the photosensitive drum 7 and thus develops the latent image formed thereon. Incidentally, the exposing device 1 includes a laser diode 1*a*, a polygonal mirror 1*b*, a lens 1*c* and a reflection mirror 1*d*, as shown in FIG. 4.

Here, as shown in FIG. 1, the developing device 9 feeds the toner contained in a toner container 11A to a developing roller (developer bearing member) 9*c* by the rotation of a toner feed member 9*b*. Then, the developing device 9 rotates the developing roller 9*c* including a stationary magnet therein, forms a toner layer to which a triboelectrification charge is given by a developing blade 9*d* on the surface of the developing roller 9*c*, and supplies such the toner to the developing area on the photosensitive drum 7. The supplied toner is transferred to the photosensitive drum 7 in accordance with the latent image, and as a result the toner image is formed. Here, the developing blade 9*d* regulates a toner amount on the circumferential surface of the developing roller 9*c* and gives the triboelectrification charge, and a toner agitating member 9*a* to agitate the toner within a developing chamber is rotatably attached in the vicinity of the developing roller 9*c*.

Then, the voltage whose polarity is opposite to that of the toner image formed on the photosensitive drum 7 is applied to the transferring roller 4 so as to transfer the toner image to the recording material 2, and thereafter the residual toner on the photosensitive drum 7 is removed by a cleaning device 10. Here, the cleaning device 10 scrapes off the residual toner on the photosensitive drum 7 by an elastic cleaning blade 10*a*, which abuts against the photosensitive drum 7, and then collects the removed toner to a waste toner reservoir 10*b*.

The process cartridge B is composed by combining a toner frame 11 having the toner container (toner containing portion) 11A containing the toner with a developing frame 12 holding the developing device 9 such as the developing roller 9*c* and the like, and further combining, with the combination of these frames, a cleaning frame 13 to which the photosensitive drum 7, the cleaning device 10 such as the cleaning blade 10*a* and the like, and the charging roller 8 are attached. The process cartridge B is detachably mountable on the apparatus main body 14 by an operator (user).

The exposing opening 1*e* for permitting irradiating light according to image information to pass to the photosensitive drum 7 and a transferring opening 13*n* for opposing the photosensitive drum 7 to the recording material 2 are provided on the process cartridge B. Specifically, the exposing opening 1*e* is provided on the cleaning frame 13, and the transferring opening 13*n* is provided between the developing frame 12 and the cleaning frame 13.

Next, the structure of the housing of the process cartridge B according to the present embodiment will be explained.

In the process cartridge B shown in the present embodiment, the photosensitive drum 7, the charging roller 8, the developing device 9, the cleaning device 10 and the like are disposed within the housing which is composed by combining the toner frame 11 with the developing frame 12, and further rotatably combining the cleaning frame 13 with the combination of the frames 11 and 12. Then, the process cartridge B is detachably mounted to a cartridge mounting means provided in the apparatus main body 14.

Structure of Housing of Process Cartridge B

As described above, the housing of the process cartridge B according to the present embodiment is composed by combining the toner frame 11, the developing frame 12 and the cleaning frame 13, and the structure of the housing will be next explained.

Figure 12:
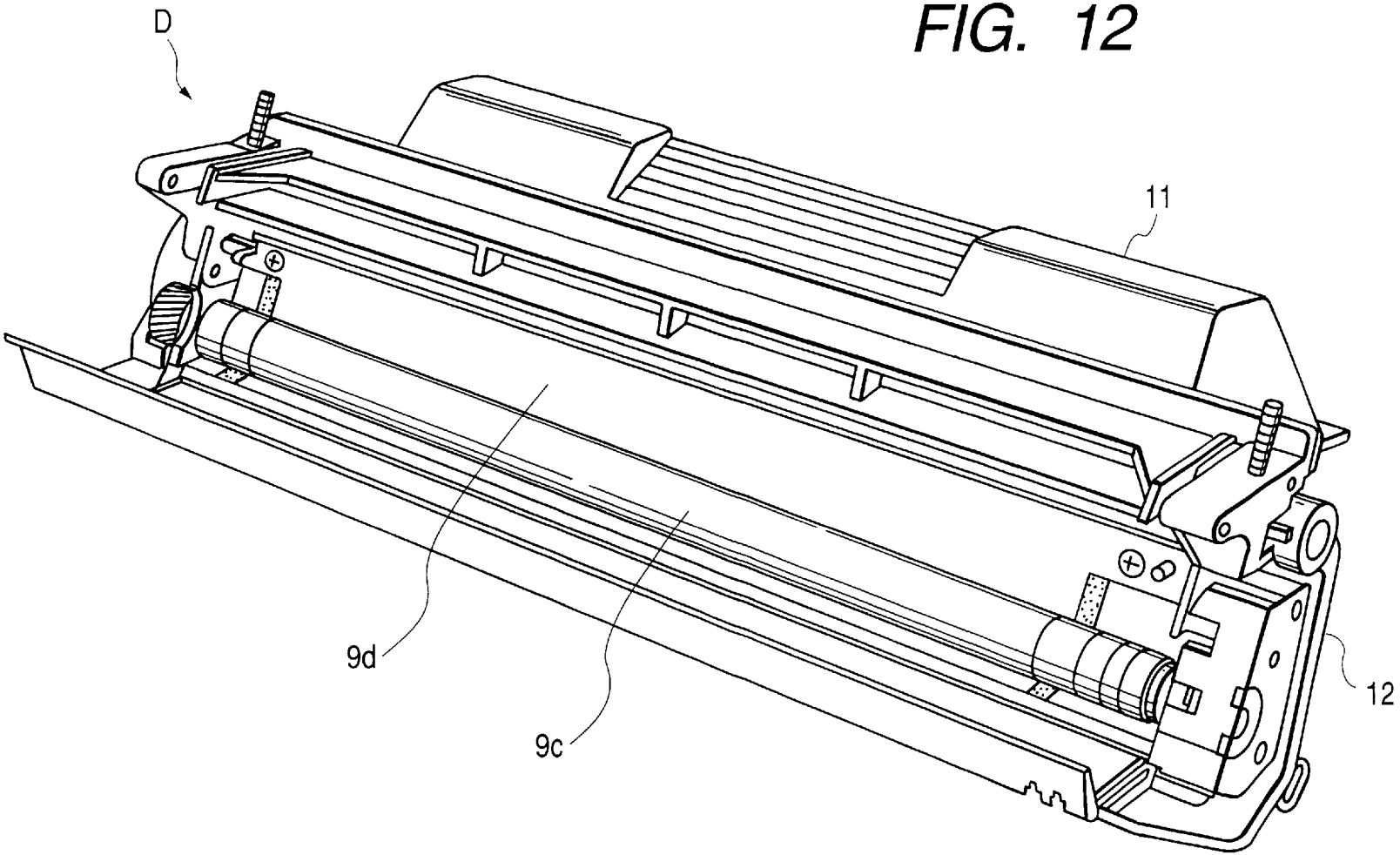
FIG. 12 is a perspective view showing a developing unit.

As shown in FIG. 1, the toner feed member 9*b* is rotatably attached to the toner frame 11, the developing roller 9*c* and the developing blade 9*d* are attached to the developing frame 12, and the toner agitating member 9*a* for agitating the toner in the developing chamber is rotatably attached in the vicinity of the developing roller 9*c*. Moreover, an antenna rod 9*h*, which is substantially parallel with the developing roller 9*c*, is attached to the developing frame 12, and the toner frame 11 and the developing frame 12 are welded together (ultrasonic welding in the present embodiment) to compose a developing unit D (see FIG. 12).

Such the process cartridge B is mounted along a direction indicated by the arrow X to the cartridge mounting portion which is seen if an openable cover 35 provided on the top of the apparatus main body 14 is opened around a hinge 35*a*, as shown in FIGS. 4 and 5.

Toner Frame

Figure 14:
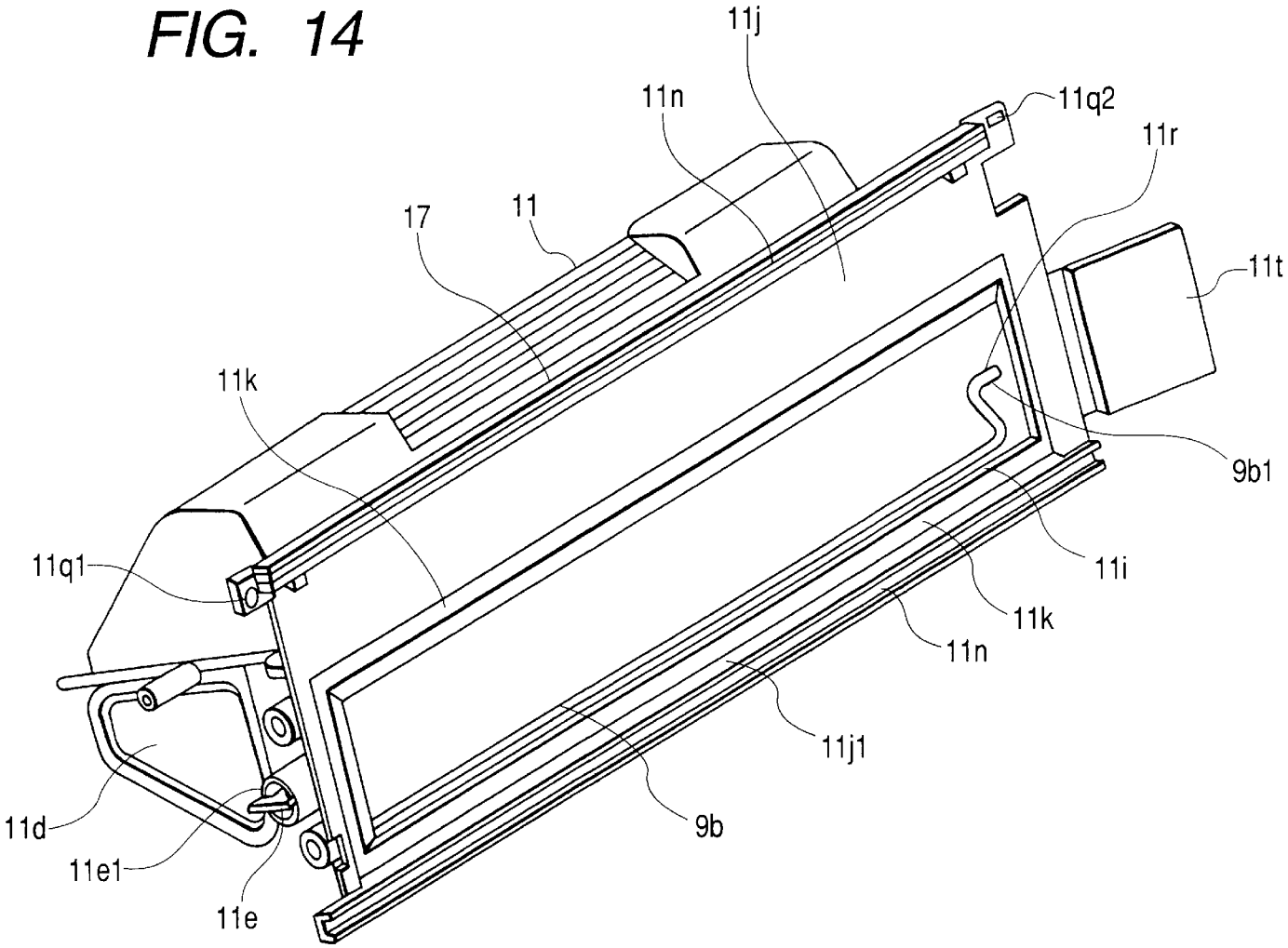
FIG. 14 is a perspective view showing the toner frame.
Figure 15:
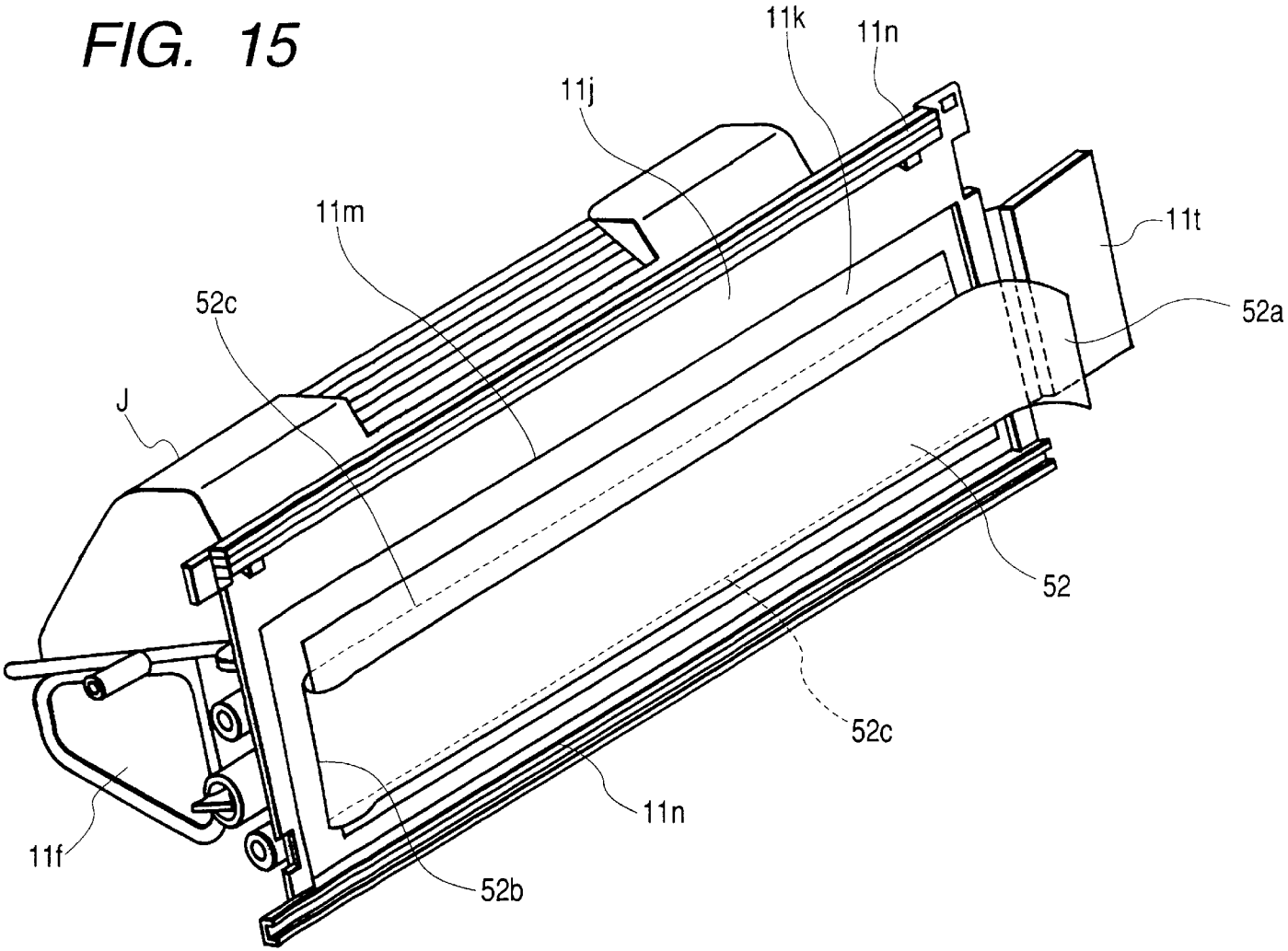
FIG. 15 is a perspective view showing the toner frame.

The toner frame will be explained in detail with reference to FIGS. 1, 9, 11, 14, 15 and 16. FIG. 14 is the perspective view showing the toner frame before a toner seal is welded, and FIG. 15 is the perspective view showing the toner frame after the toner frame was filled with the toner.

Figure 3:
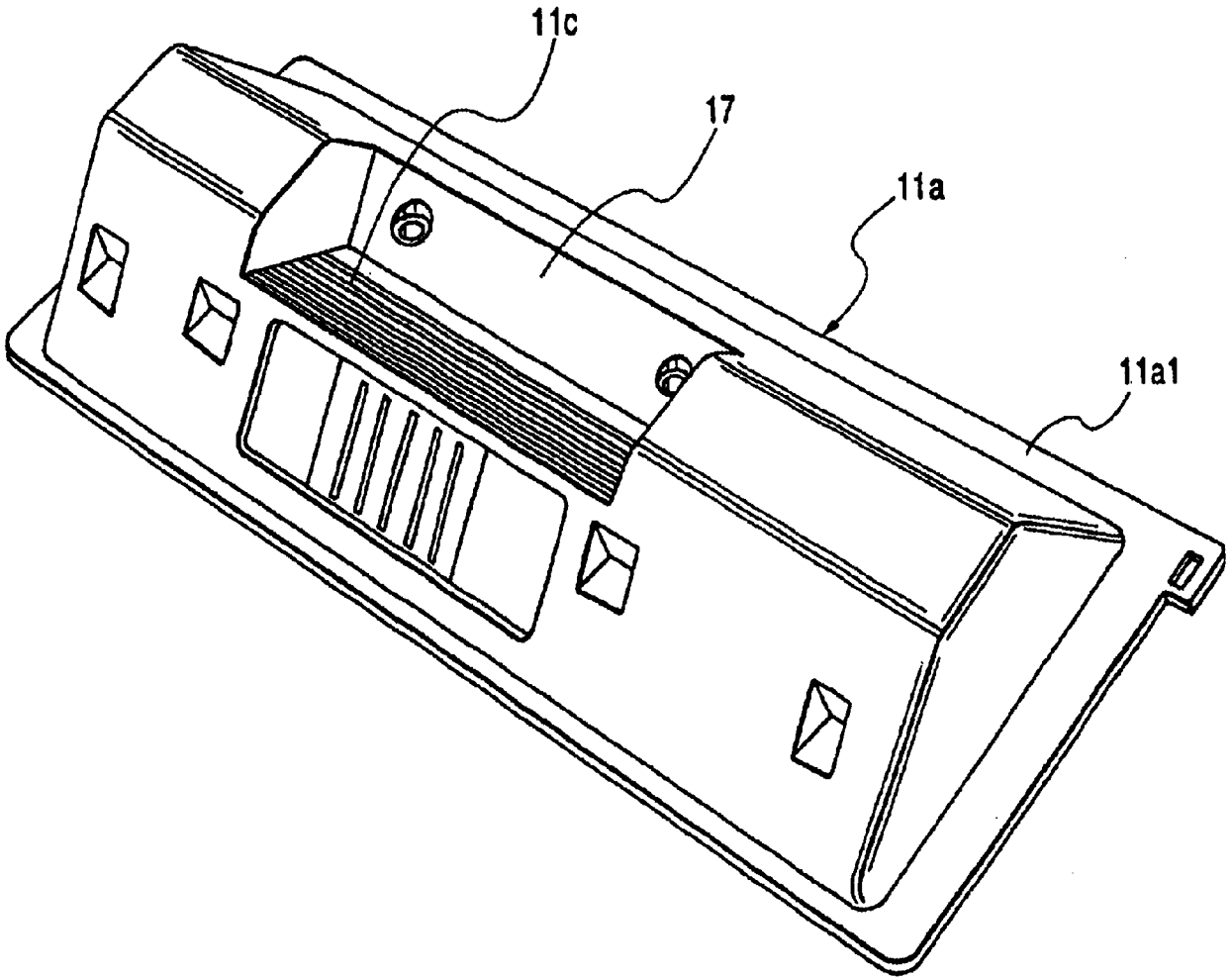
FIG. 3 is a perspective view showing an upper frame.

As shown in FIG. 1, the toner frame 11 is composed of two-piece parts, i.e., an upper frame (first frame) 11*a* and a lower frame (second frame) 11*b*. The upper frame 11*a* is bulged upward so that it occupies the space in the right of the exposing device 1 of the apparatus main body 14 as shown in FIG. 1, and as a result the toner amount of the process cartridge B can be increased without enlarging the image forming apparatus A. As shown in FIGS. 1, 2 and 3, a concave portion 17 is provided at the center of the outer surface of the upper frame 11*a* along its longitudinal direction and thus functions as a grip, so that the operator grips the concave portion 17 of the upper frame 11*a* and the lower side of the lower frame 11*b* and holds the process cartridge B. Longitudinal ribs 11*c* provided on the one side of the concave portion 17 and the lower side of the lower frame 11*b* function as antislip ribs when the operator holds the process cartridge B.

Figure 24:
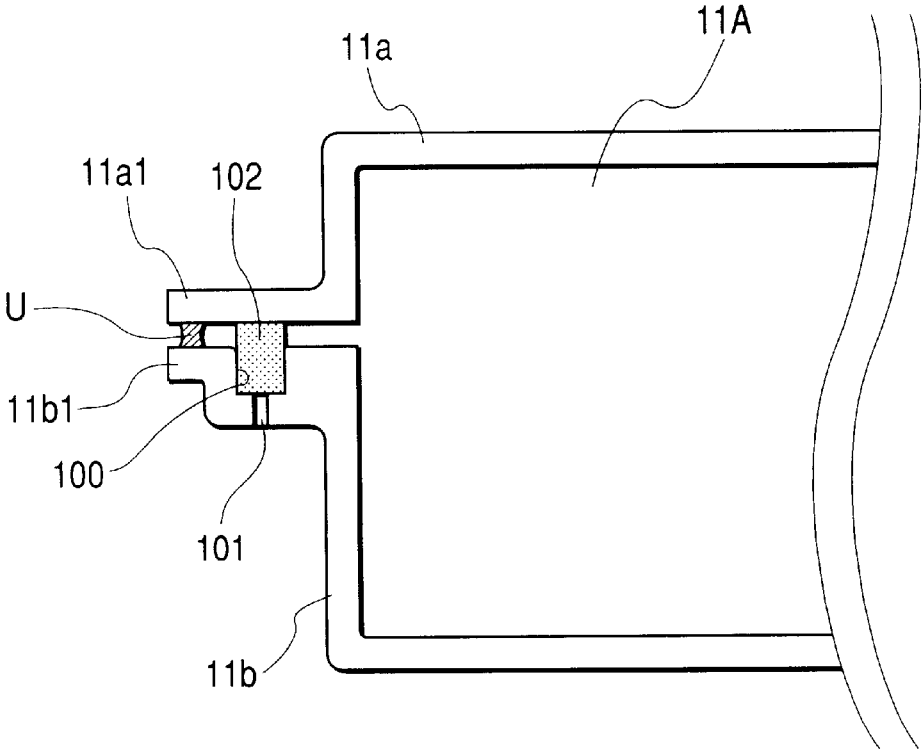
FIG. 24 is a sectional view showing a connected state of the upper and lower frames of a toner container and a pressure regulating portion.

As shown in FIG. 1, a flange 11*a*1 of the upper frame (first frame) 11*a* is fitted to and aligned with a flange 11*b*1 of the lower frame (second frame) 11*b* at a welding surface U, and the welding ribs provided on the upper frame 11*a* are welded by the ultrasonic welding to connect the upper and lower frames 11*a* and 11*b* with each other as a unitary body. Therefore, as shown in FIG. 24, a small clearance into which the toner can migrate remains between the connected surfaces of the upper and lower frames 11*a* and 11*b* after the welding. By such the ultrasonic welding, the welding surface U between the respective flanges 11*a*1 and 11*b*1 of the upper and lower frames 11*a* and 11*b* is established, and at this time the clearance which communicates the inside of the toner frame 11 with a counterbore portion (hollow portion) 100, which is described later, is formed on the part of the welding surface U. In the present embodiment, the inside and the outside of the toner container 1 communicate with each other through this clearance and the counterbore portion 100. Incidentally, the connecting method of the welding surface U is not limited to ultrasonic welding but can include, e.g., hot welding, forced vibration (ultrasonic sealing), adhesion or the like. When the upper and lower frames 11*a* and 11*b* are ultrasonic-welded, the upper and lower frames 11*a* and 11*b* are supported through the flange 11*b*1. Besides, a step portion 11*m* is provided on a plane at substantially the same level as the flange 11*b*1 above the outside of an opening (developer supplying opening) 11*i*, and the part of the upper frame 11*a* is engaged with the step portion 11*m*.

Figure 13:
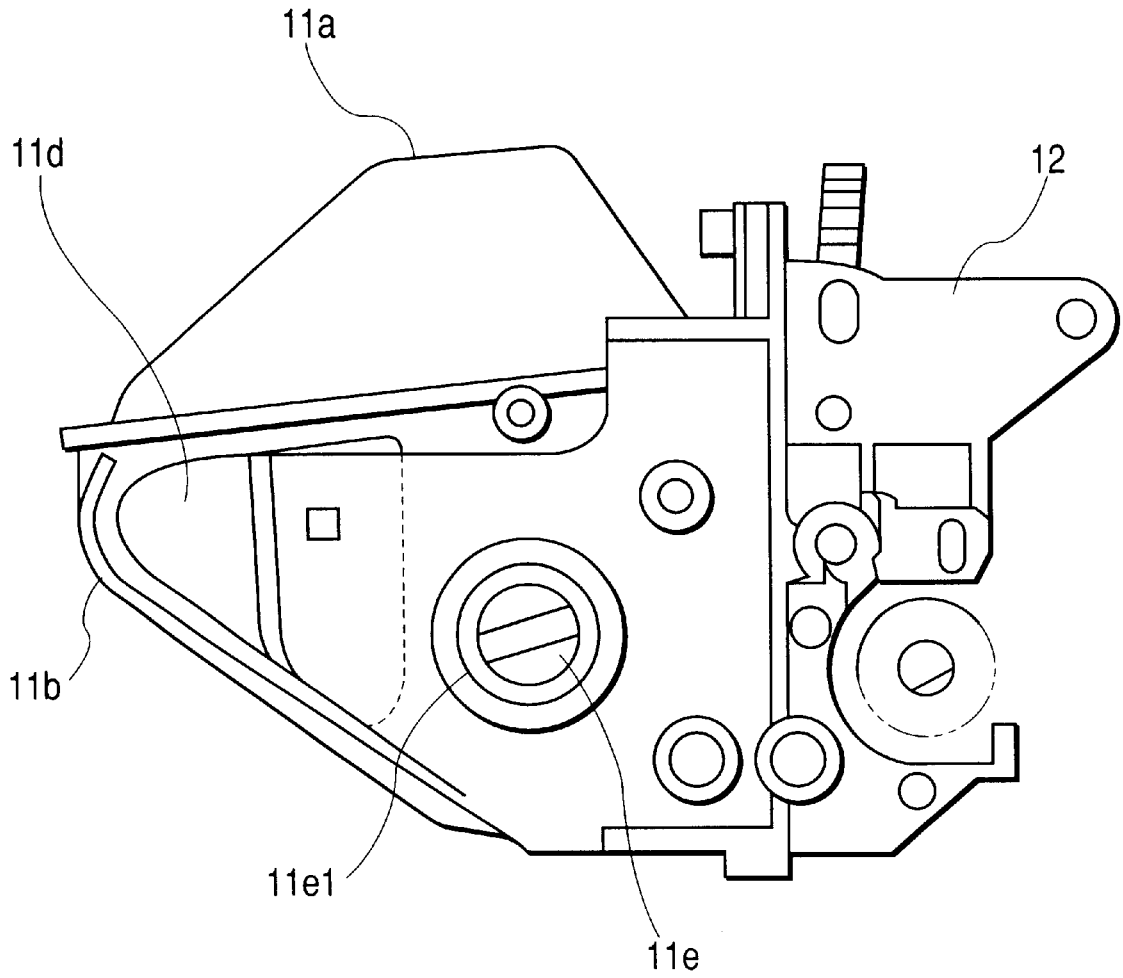
FIG. 13 is a side view showing the side plate of a developing frame and a toner frame.

Before the upper and lower frames 11*a* and 11*b* are welded, the toner feed member 9*b* is incorporated inside the lower frame 11*b*. Moreover, as shown in FIG. 13, a coupling member 11*e* is incorporated through a hole 11*e*1 on the side plate of the toner frame 11 to be stopped by the end of the toner feed member 9*b*. The hole 11*e*1 is provided at the side end of the lower frame 11*b* in its longitudinal direction, and an approximately right-triangle toner filling opening 11*d* is provided at the same side as that of the hole 11*e*1 to fill the toner into the cartridge. The toner filling opening 11*d* has an edge extending near the seam of the upper and lower frames 11*a* and 11*b* and positioned at the right angle side, a vertical edge perpendicular to the above edge, and an oblique edge extending along the lower side of the lower frame 11*b*, whereby the toner filling opening 11*d* has a maximum size. The hole 11*e*1 and the toner filling opening 11*d* are provided in parallel. As shown in FIG. 14, the opening 11*i* for feeding the toner from the toner frame 11 to the developing frame 12 is provided in the longitudinal direction of the toner frame 11, and a seal (later described) is welded to close the opening 11*i*. After this, the toner is filled from the toner filling opening 11*d*, and this opening 11*d* is closed by a toner cap 11*f* as shown in FIG. 15, whereby a toner unit J is completed. The toner cap 11*f* is formed by a material such as polyethylene, polypropylene or the like, and is compressed into or adhered to the toner filling opening 11*d* of the toner frame 11 so as not to come off. Moreover, the toner unit J is ultrasonic-welded to the later described developing frame 12 to compose the developing unit D shown in FIG. 12. The connecting method of the toner unit J is not limited to the ultrasonic welding and can include adhesion, snap fitting using elasticity, or the like.

Moreover, as shown in FIG. 1, an oblique surface K of the lower frame 11*b* of the toner frame 11 forms an oblique angle o by which the toner naturally falls within the frame 11 if it is consumed. The angle θ, which is formed by the oblique surface K of the process cartridge B mounted on the apparatus main body 14 and a horizontal line Z in the state that the apparatus main body 14 is being horizontalized, is preferably about 65°. The lower frame 11*b* has a downward concave portion 11*g* to escape from the rotation area of the toner feed member 9*b*. Since the rotation diameter of the toner feed member 9*b* is about 37 mm, the concave portion 11*g* may be about 0 mm to 10 mm from the extended line of the oblique surface K. According to the present embodiment, the toner can be surely fed from the toner frame 11 to the developing frame 12.

It should be noted that a rodlike iron material whose diameter is about 2 mm is used for the toner feed member 9*b*, and the toner feed member 9*b* itself has a crank shape. As shown in FIG. 14, one of journals 9*b*1 respectively provided at both ends of the toner feed member 9*b* is pivotally mounted to a hole 11*r* on the part facing the inside of the opening 11*i* of the toner frame 11, and the other of the journals 9*b*1 is fixed to the coupling member 11*e* (though the connected portion is not seen in FIG. 14).

As noted above, by providing the concave portion 11*g* as the escape of the toner feed member 9*b* on the bottom of the toner frame 11, stable toner feed performance can be obtained without increasing costs.

Figure 16:
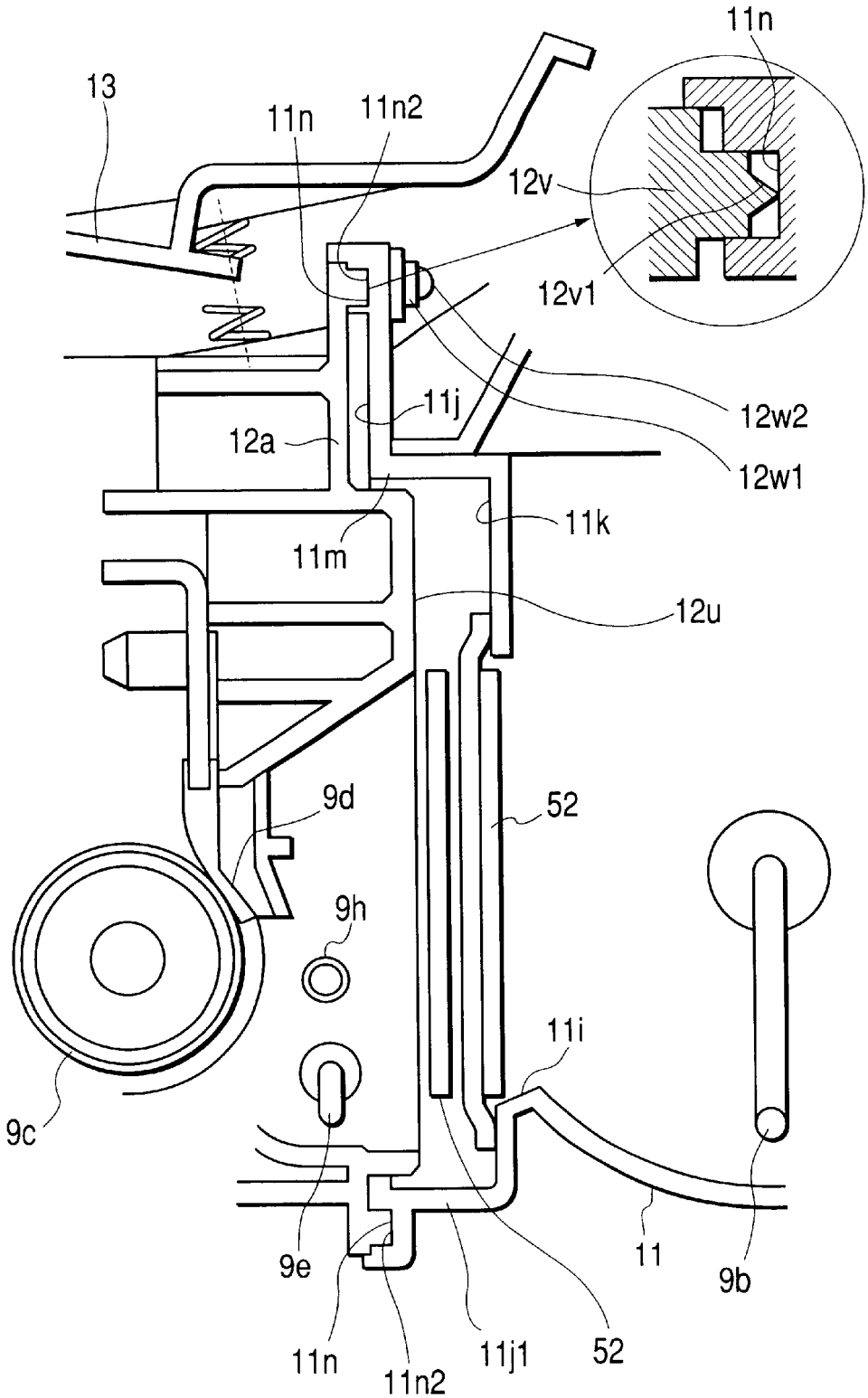
FIG. 16 is a vertical sectional view showing a toner seal member.
Figure 17:
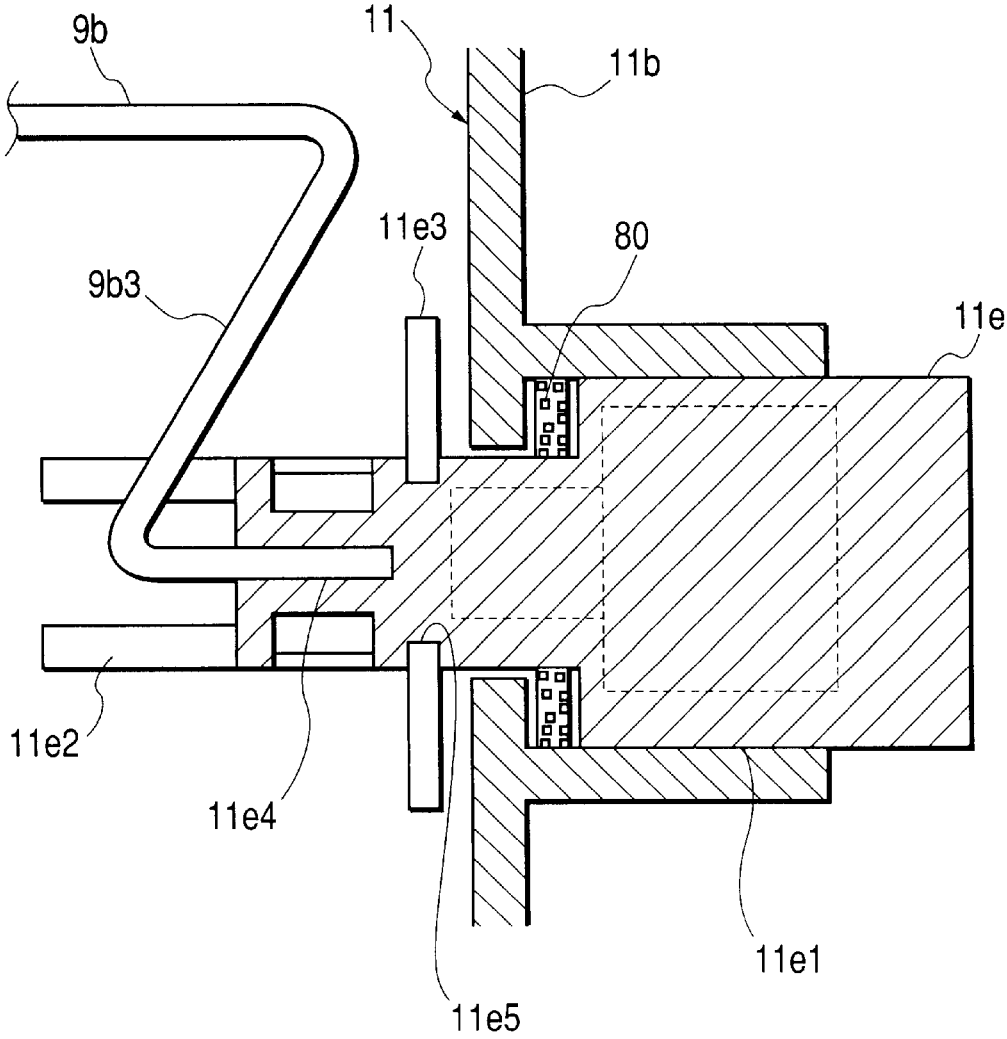
FIG. 17 is a vertical sectional view showing the shaft-sealed portion of a conventional coupling member.
Figure 18A:
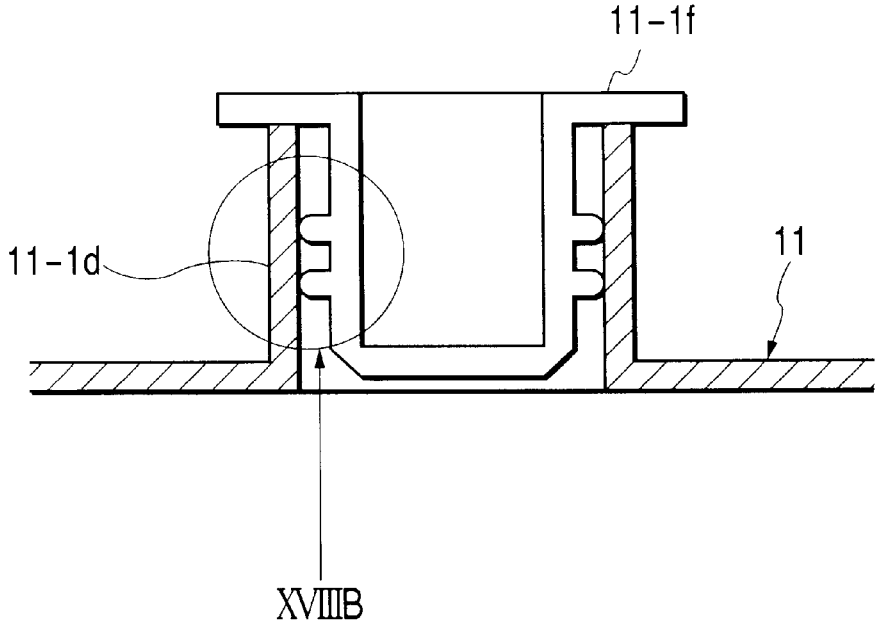
FIG. 18A is a vertical sectional view showing a conventional toner cap.
Figure 18B:
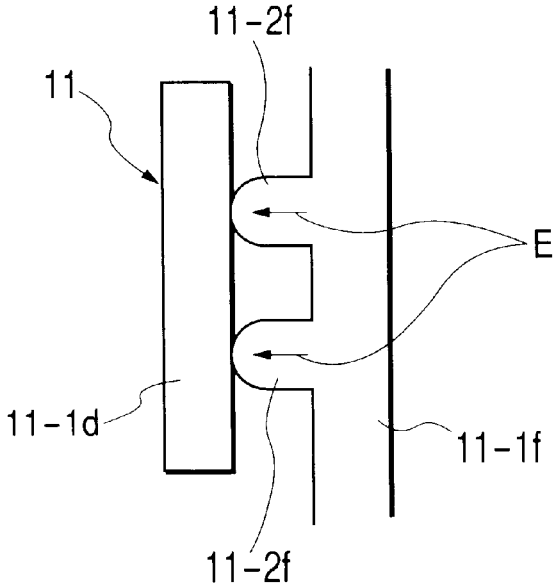
FIG. 18B is an enlarged vertical sectional view showing the encircled portion XVIII B of FIG. 18A.
Figure 19:
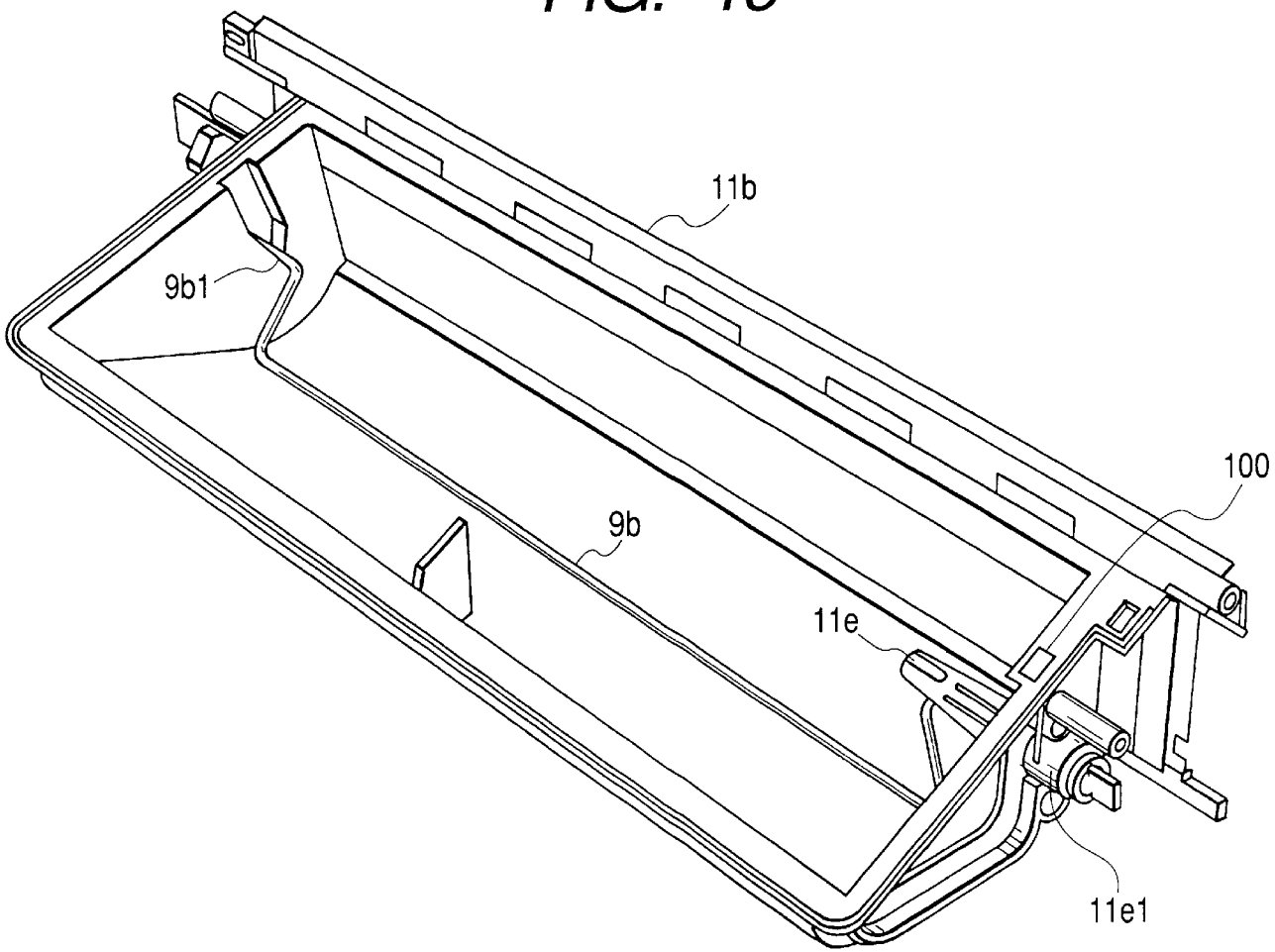
FIG. 19 is a perspective view showing a lower frame.
Figure 20:
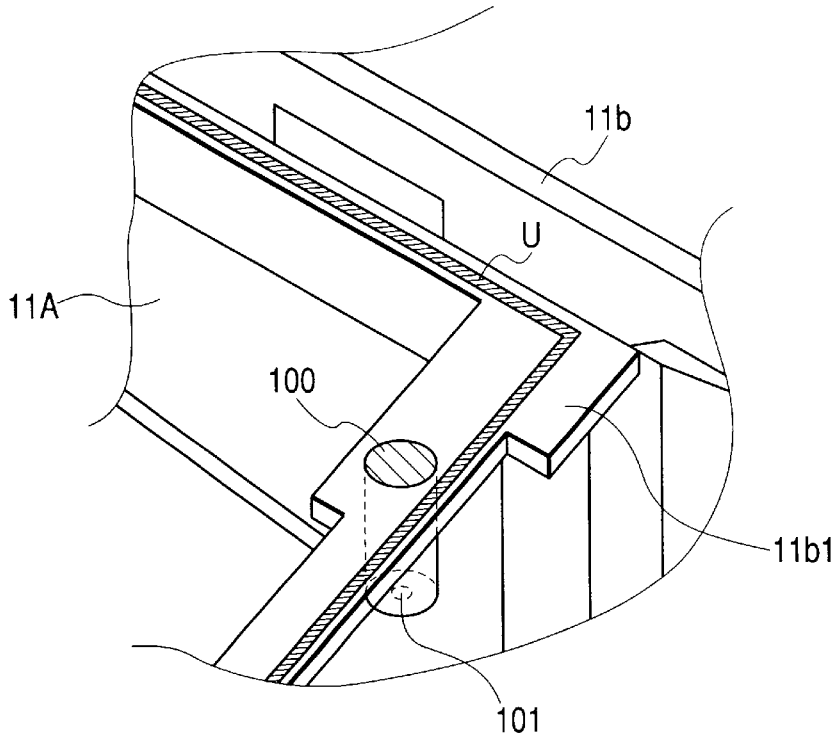
FIG. 20 is an enlarged perspective view showing the vicinity of a counterbore in the embodiment 1.

As shown in FIGS. 1, 14 and 16, the opening 11*i* for feeding the toner from the toner frame 11 to the developing frame 12 is provided at the connecting portion of the toner frame 11 to the developing frame 12, and a concave surface 11*k* is provided around the opening 11*i*. Striped grooves 11*n* are arranged in parallel along the longitudinal direction respectively at the upside of an upper flange 11*j* above the concave surface 11*k* and at the downside of a lower flange 11*j*1 below the concave surface 11*k*. The upper flange 11*j* on the concave surface 11*k* has a gatelike shape, and the lower flange 11*j*1 intersects the concave surface 11*k*. As shown in FIG. 16, a bottom 11*n*2 of each striped groove 11*n* is at the position protruding outward (developing frame 12 side) from the concave surface 11*k*.

As shown in FIGS. 15 and 16, a toner seal (seal member) 52 formed by laminating PET (polyethylene terephthalate) films on and under an Al (aluminum) film is adhered to the concave surface 11*k* in its longitudinal direction to cover the opening 11*i* of the toner frame 11. Moreover, since slits 52*c* are provided on one of the laminated PET films of the toner seal 52 to open the opening 11*i*, the toner seal 52 is broken along the slits 52*c* by a later-described unsealing operation, whereby the opening 11*i* of the toner frame 11 is opened.

The toner seal 52 is folded at an end 52*b* of the opening 11*i* in its longitudinal direction and drawn out between the toner frame 11 and an elastic seal material (not shown) such as felt adhered to the end of the longitudinal-direction surface opposite to the toner frame 11 of the developing frame 12, and a grip member 11*t* serving as a tab is attached to a drawn-out end 52*a* of the toner seal 52 (FIGS. 14 and 15). The grip member 11*t* is formed integrally with the toner frame 11, and the connected portion between the grip member 11*t* and the toner frame 11 is specifically thinned or frangible so that the grip member 11*t* can be easily removed. Moreover, the end 52*a* of the toner seal 52 is adhered to the grip member 11*t*, and a synthetic resin film tape (not shown) having a small coefficient of friction is adhered to the inner side on the surface of the elastic seal material provided on the developing frame 12. Moreover, on the plane surface of the developing frame 12, another elastic seal material (not shown) is adhered to the longitudinal-direction edge of the opposite side of the position to which the elastic seal material is adhered.

The above elastic seal materials are adhered over the entire width in the lateral (short-edge) direction at both the ends of the flange 12*a* in its longitudinal direction, and the elastic seal material is aligned with the flange 11*j* at both the ends of the concave surface 11*k* in its longitudinal direction and overlap a protruded ridge 12*v* of FIG. 16 over the entire width in the lateral direction of the flange 11*j*.

Furthermore, to easily register the toner frame 11 and the developing frame 12 when these frames are connected, a round-shaped hole 11*q*1 and a square-shaped hole 11*q*2 (FIG. 14), respectively fit to a cylindrical dowel 12*w*1 and a square-shaped dowel 12*w*2 (FIG. 16) provided at both the ends of the developing frame 12 in its longitudinal directions, are provided on the flange 11*j* of the toner frame 11. Here, the round-shaped hole 11*q*1 is fit to the cylindrical dowel 12*w*1 tightly, and the square-shaped hole 11*q*2 is fit to the square-shaped dowel 12*w*2 tightly in the lateral direction and roughly in the longitudinal direction.

When the toner frame 11 and the developing frame 12 are connected together, each of the frames 11 and 12 is assembled independently as a subassembly, and then the cylindrical dowel 12*w*1 and the square-shaped dowel 12*w*2 for positioning (registration) of the developing frame 12 are respectively fitted into the round-shaped hole 11*q*1 and the square-shaped hole 11*q*2 for positioning (registration) of the toner frame 11. Further, the protruded ridges 12*v* of the developing frame 12 are fitted into the striped grooves 11*n* of the toner frame 11 respectively, and the toner frame 11 and the developing frame 12 are brought into pressure contact with each other, and as a result the seal materials provided at both the ends of the flange 12*a* of the developing frame in its longitudinal direction is brought into contact with the flanges 11*j* at both the ends of the toner frame 11 in its longitudinal direction and then compressed. In such a state, the toner frame 11 and the developing frame 12 are pressed, and ultrasonic vibration is applied between the protruded ridge 12*v* and the striped groove 11*n*, whereby a triangle protruded ridge 12*v*1 is welded to the bottom of the striped groove 11*n* by frictional heat. Thus, an edge of the striped groove 11*n* of the toner frame 11 and a spacer protruded ridge (not shown) of the developing frame 12 are in tight contact with each other, a space whose surrounding edges are tightly closed is provided between the concave surface 11*k* of the toner frame 11 and an opposite surface 12*u* of the opposite developing frame 12, and the toner seal 52 is held in this space.

To feed the toner contained in the toner frame 11 to the developing frame 12, the root side of the grip member 11*t* (FIGS. 9 and 15), to which the end 52*a* of the toner seal 52 which is protruding outside the process cartridge B has been adhered, is removed from the toner frame 11. Then, the toner seal 52 is torn along the slits 52*c* if the operator pulls the grip member 11*t* by his hand, whereby the opening 11*i* of the toner frame 11 is opened, and the toner can be thus fed from the toner frame 11 to the developing frame 12. Only the thickness at both the edges of the flange 11*j* of the toner frame 11 in its longitudinal direction changes to be thinner while the elastic seal material of the developing frame 12 maintains a flat band-like rectangle, whereby seal capability is excellent.

Moreover, when the toner frame 11 and the developing frame 12 are ultrasonic-welded, frictional heat is generated, and the triangle protruded ridge 12*v*1 becomes molten by the generated frictional heat. Therefore, there is a fear that a thermal stress is caused by the frictional heat and thus the toner frame 11 and the developing frame 12 deform thermally. According to the present embodiment, however, since the protruded ridge 12*v* of the developing frame 12 is fitted into the striped groove 11*n* entirely in the longitudinal direction, the welded portion and its circumference are reinforced in the state that the frames 11 and 12 are connected, the thermal deformation due to the thermal stress is not caused easily.

As materials to form the toner frame 11 and the developing frame 12, plastic such as polystyrene, an ABS resin, an acrylonitrile/butadiene/styrene copolymer, polycarbonate, polyethylene, polypropylene and the like can be used.

Here, FIG. 1 is the side sectional view showing the toner frame 11 used in the present embodiment. In FIG. 1, a connecting surface JP by which the toner frame 11 is connected with the developing frame 12 is disposed approximately in the vertical direction.

The toner frame 11 used in the present embodiment will be further explained in detail. As shown in FIG. 1, to effectively let fall the mono-component toner contained in the toner container 11A toward the direction of the opening 11*i*, the toner frame 11 includes two oblique surfaces K and L. Both the oblique surfaces K and L are provided over the entire width in the longitudinal direction of the toner frame 11, the oblique surface L is disposed above the opening 11*i*, and the oblique surface K is disposed on the inner side of the opening 11*i* (in the lateral direction of the toner frame 11). Further, the oblique surface L is formed in the upper frame 11*a*, the oblique surface K is formed in the lower frame 11*b*, and the oblique surface L faces toward the vertical direction or faces downwardly rather than the vertical direction in the state that the process cartridge B is being mounted on the apparatus main body 14. An angle θ3 which is formed by the horizontal line Z and a line "m" perpendicular to the connecting surface JP of the toner frame 11 and the developing frame 12 is about 20° to 40°. In other words, in the present embodiment, when the lower frame 11*b* is connected to the upper frame 11*a*, the shape of the upper frame 11*a* is regulated so that the lower frame 11*b* can be set with the above setting angle. Thus, according to the present embodiment, the toner container 11A containing the toner can effectively feed the toner to the opening 11*i*.

Figure 6A:
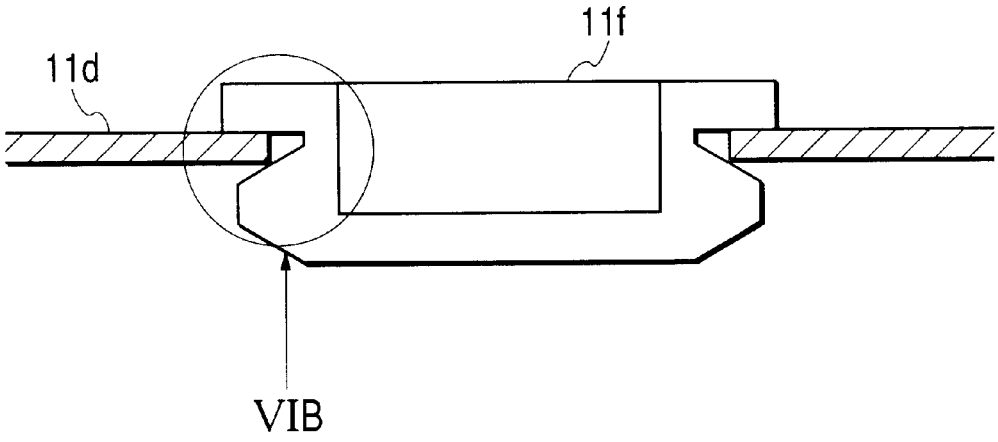
FIG. 6A is a vertical sectional view for explaining a sealed state by a toner cap.
Figure 6B:
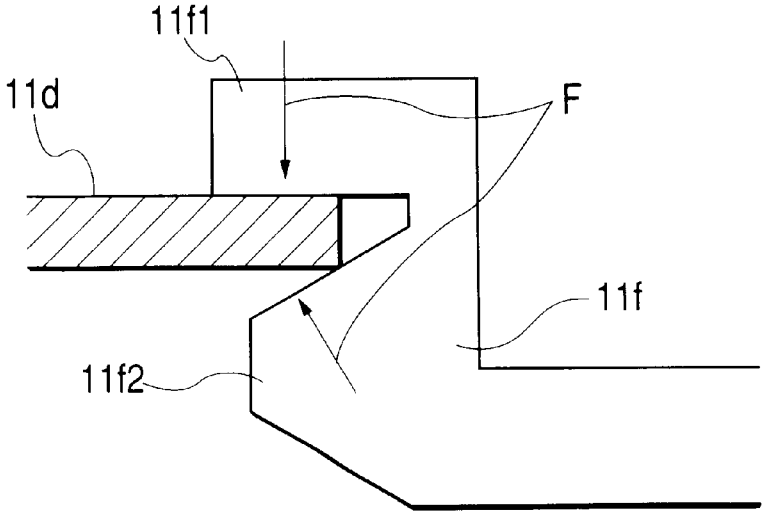
FIG. 6B is an enlarged vertical sectional view showing the encircled portion VI B of FIG. 6A.

As shown in FIGS. 6A and 6B, a toner cap 11*f* nips the circumferential edge of the toner filling opening 11*d* of the lower frame 11*b* by using a flange 11*f*1 and a convex portion 11*f*2 as indicated by arrows F, whereby toner leakage is prevented. Therefore, there is no air permeability between the toner filling opening 11*d* and the toner cap 11*f*.

The shaft-sealing of the coupling member 11*e* will be explained with reference to FIG. 7.

Figure 7:
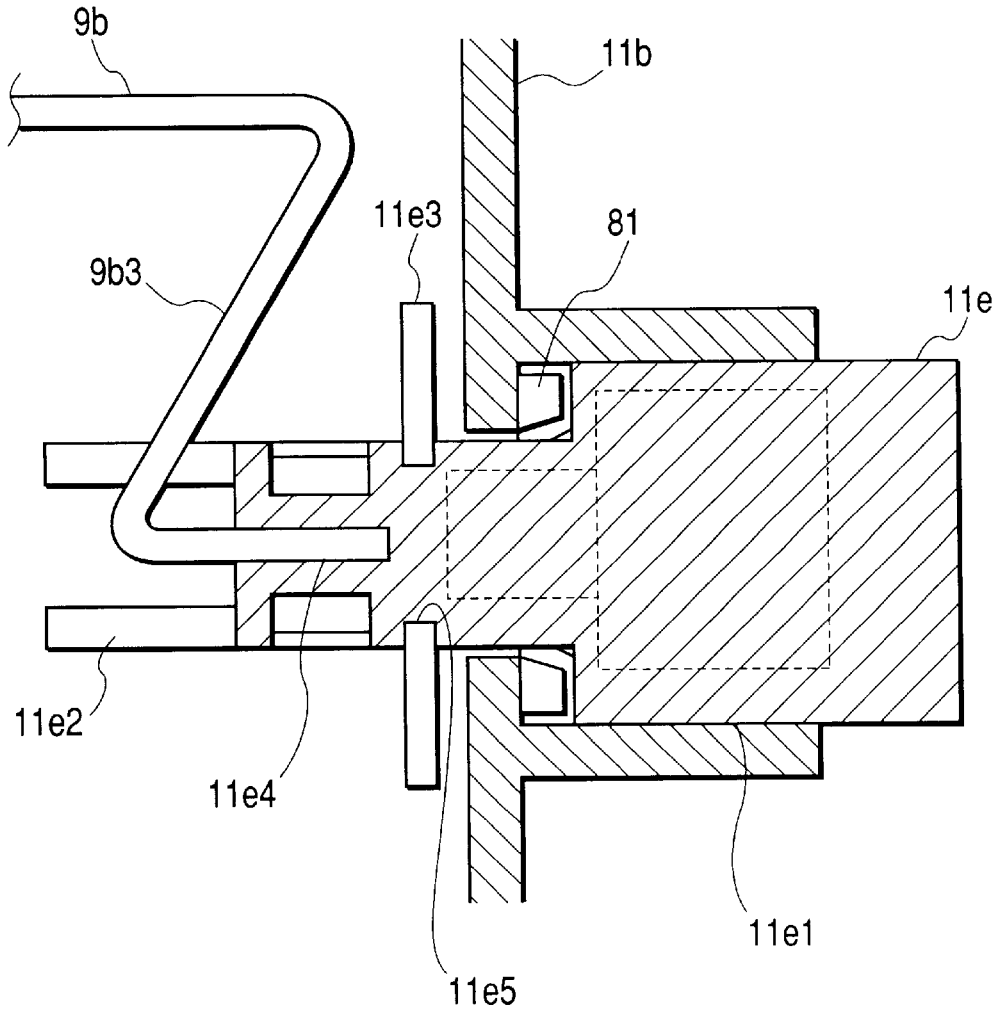
FIG. 7 is a vertical sectional view showing the shaft-sealed portion of a coupling member.

As shown in FIG. 7, the coupling member 11*e* is rotatably fitted into a hole 11*e*1 of the lower frame 11*b*, and the coupling member 11*e* has a circumferential groove 11*e*5, whereby the coupling member 11*e* does not 20 come off in the axial direction by an E-ring 11*e*3 fitted into the groove 11*e*5. A crank-shaped arm 9*b*3 of the toner feed member 9*b* whose journal is fitted into a central hole 11*e*4 of the coupling member 11*e* is fitted into a slit 11*e*2 extending over the diameter of 25 the inner end portion of the coupling member 11*e*.

The coupling member 11*e* is shaft-sealed by an oil seal (shaft-sealing means) 81 fitted into the hole 11*e*1. Air permeability in case of shaft-sealing by the oil seal 81 is extremely low. Though grease might be applied to prevent agglomerated toner from occurring, by doing so, the air permeability is deteriorated more and more. Therefore, the respective openings of the toner frame 11 are sealed by the toner seal 52, the toner cap 11*f* and the oil seal 81 respectively, and there is no air permeability at these positions.

The features of the present embodiment will be explained with reference to FIGS. 19, 20, 21, 22A, 22B and 24.

The cylindrical counterbore portion (hollow portion) 100 whose diameter is 4.5 mm and whose depth is 4.5 mm is provided inside the welded portion of the welding surface U of the flange 11*b*1 provided around the lower frame 11*b*, and a vent 101 whose diameter is about 2 mm is provided on the bottom of the counterbore portion 100 to secure air permeability of the toner container 11A. Here, the hollow portion 100 having the vent 101 and a filter 102 constitute a pressure regulating means, and the pressure regulating means is provided between the toner container 11A and the welding surface U.

Figure 21:
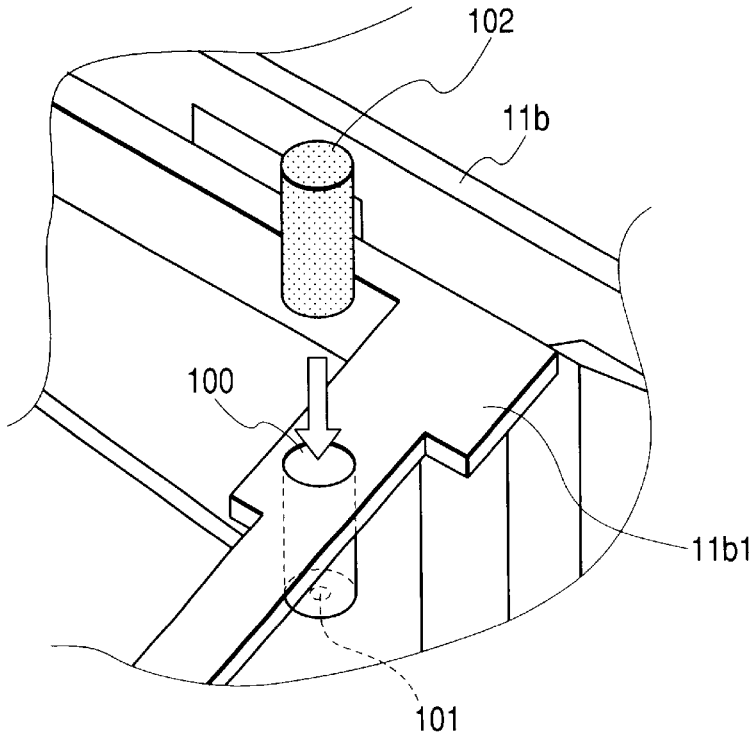
FIG. 21 is an enlarged perspective view showing a state that an air-permeable seal member is inserted into the counterbore in the embodiment 1.

As shown in FIG. 21, the cylindrical air-permeable seal member (filter) 102 whose diameter is 5.5 mm and whose height is 7 mm is inserted into the counterbore portion 100. The air-permeable seal member 102 uses, as its material, polyurethane foam the number of cells of which is about 55 cells per 25 mm to ensure air permeability and toner seal capability. Therefore, the height and the diameter of the filter before it is inserted into the hollow portion are larger than the depth and the diameter of the hollow portion, respectively.

Figure 22A:
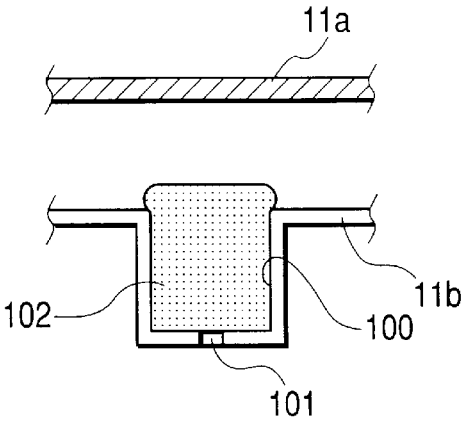
FIG. 22A is a schematic view showing a state that the air-permeable seal member has been disposed in the counterbore in the embodiment 1.
Figure 22B:
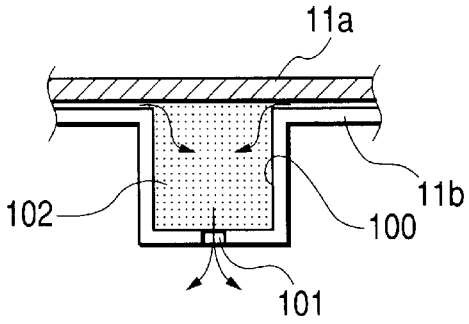
FIG. 22B is a schematic view showing a state that the air-permeable seal member is pushed by an attachment portion.

As shown in FIGS. 22A and 22B, after the air permeable seal member 102 was inserted into the counterbore portion 100, the upper frame 11*a* is connected at the welding surface U, whereby the seal member 102 is pressed down by the upper frame 11*a* and thus is prevented from coming off. Moreover, the upper frame 11*a* has a function to compress the filter 102.

If the air in the toner container 11A expands by a change in the environments such as a temperature or the like or by the distribution of goods or the like, the expanded air passes the clearance of the welding surface U between the upper and lower frames 11*a* and 11*b* and is exhausted outward from the vent 101 through the air-permeable seal member 102 as shown by the arrows in FIG. 22B. Thus, it is possible to prevent that the inner pressure of the toner container 11A from rising to an extreme, whereby damage of the toner seal, deformation of the toner container 11A, and toner leakage when the toner seal 52 is opened can be prevented.

Conversely, if the air in the toner container 11A is compressed, air flows into the container along the path opposite to the above air exhaust path, whereby it is possible to prevent the inner pressure from falling to an extreme extent.

As described above, by providing the path for ventilation (air permeability) in the clearance of the flanges of the first and second frames at the connecting surface of the frames, the air flows but the toner does not easily flow into the air-permeable seal member 102 and the vent 101.

Further, since the filter 102 has the sufficient thickness in the depth direction of the hollow portion 100, it is possible to prevent the toner from reaching the vent 101 if the toner flows into the clearance between the first frame 11*a* and the second frame 11*b*. Moreover, since the filter 102 is compressed and inserted into the hollow portion 100, the clearance between the filter 102 and the hollow portion 100 can be closed even if the filter 102 is not adhered or welded to the inner circumferential surface of the hollow portion 100, whereby sufficient seal performance can be ensured. Particularly, by making the shapes of the filter 102 and the inside of the hollow portion 100 cylindrical as in the present embodiment, a restitutive force of the filter 102 is uniformly applied to the inner circumferential surface of the hollow portion 100, whereby the seal performance can be improved.

Incidentally, the material of the air-permeable seal member 102 is not limited to the above polyurethane foam but may include filters of other materials and structures if they have elasticity. For example, materials such as nonwoven fabric, rubber sponge and the like which produce a filtering effect and have both air permeability and the toner seal performance can be used as the seal member. As above, other filters of arbitrary materials can be used if they have both air permeability and toner seal performance.

To ensure the toner seal performance, the diameter and the height of the above air-permeable seal member 102 are set to be larger by about 1 mm and about 2.5 mm respectively than those of the cylindrical counterbore portion 100. Thus, the toner leakage from the vent 101 is effectively prevented by compressing and force-fitting the seal member 102 into the counterbore portion 100.

The merits of making the air-permeable seal member 102 and the inside of the counterbore portion 100 cylindrical are that the seal member 102 is not easily wrinkled when it is inserted into the counterbore portion 100, and that a compression amount of the seal member 102 becomes even over the entire circumference because its section is a circle, whereby the toner leakage does not occur.

Embodiment 2

Figure 23:
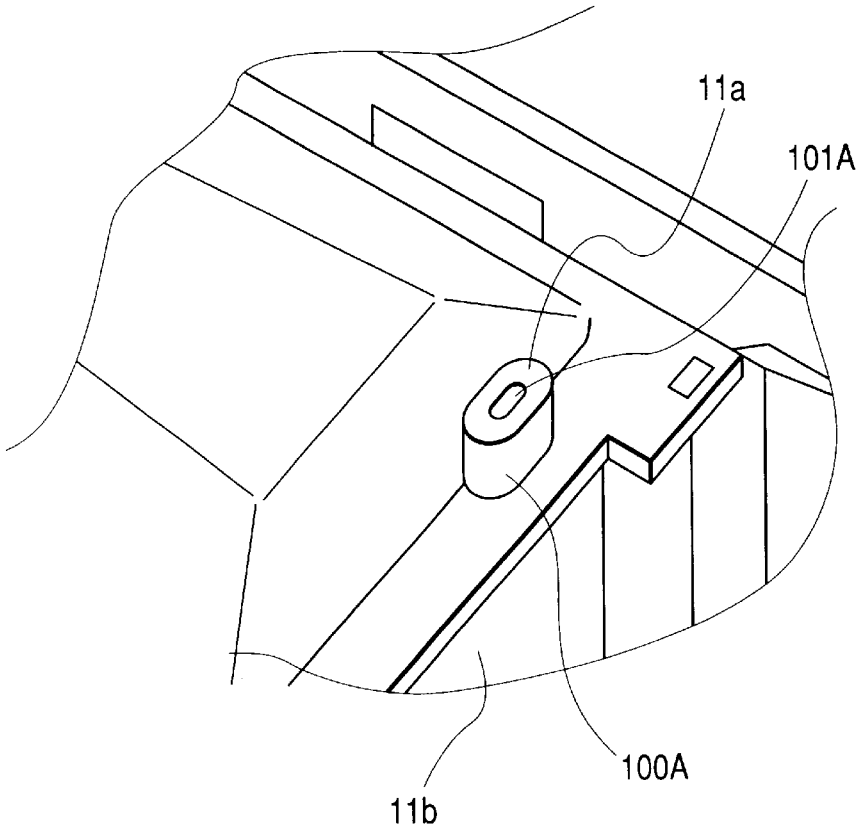
FIG. 23 is an enlarged perspective view showing a counterbore in the embodiment 2.

In the above embodiment 1, the example that the counterbore portion 100 and the vent 101 are provided downward on the lower frame 11*b* is described. However, as shown in FIG. 23, it is possible to adopt the structure that a counterbore portion 100A and a vent 101A are provided on the upper frame 11*a*, the air-permeable seal member 102 is inserted into the counterbore portion 10A, and the inserted seal member 102 is pressed by the lower frame 11*b*. Also in this case, the same effects as those in the above embodiment 1 can be obtained.

Moreover, irrespective of the structures of the upper and lower frames, it is apparent that the same effects as above can be obtained by applying the present invention to either of the connecting surfaces of the toner container formed by connecting the plural frames.

Moreover, the sectional shapes of the counterbore portions 100 and 100A and the air-permeable seal member 102 are not limited to the cylindrical shape, but may be polygonal shapes because the hollow portion can be sealed even by a polygonal-shaped seal to obtain the same effects. However, as described above, the cylindrical shape is preferable.

Though the process cartridge is mentioned in the above embodiments 1 and 2, the present invention can be applied to a developing device detachably mountable on the apparatus main body 14. For example, in the image forming apparatus A of FIG. 1, such a structure as above is achieved by disposing the photosensitive drum 7 on the side of the apparatus main body 14 and detachably mounting the developing unit D on the apparatus main body 14.

For example, if the detachably mountable developing unit D is used in a multicolor image forming apparatus (e.g., color image forming apparatus), it is possible to mount the developing unit D on a rotatable rotary unit, dispose the developing unit D of the color used for developing the electrostatic latent image on the photosensitive drum to the developing position opposite to the photosensitive drum by the rotation of the rotary unit, and then perform the developing. In this case, each developing unit D is not detachably mounted directly on the apparatus main body but is detachably mounted on the rotary unit. On the other hand, in the image forming apparatus in which plural developing units are provided and are arranged to be opposite to the photosensitive drum and a developing slide to linearly move the developing units for developing the electrostatic latent image on the photosensitive drum with respect to the photosensitive drum, the developing unit is detachably mounted on the developing slide.

The present invention is not limited to the above examples but includes various modifications within the technical concept.

What is claimed is:

1. A cartridge detachably mountable to an image forming apparatus, comprising:

a developer container; and pressure regulating means for regulating air pressure in said developer container, said pressure regulating means including a hollow portion having a vent and an elastic filter being compressed into said hollow portion.

2. A cartridge according to claim 1, wherein said filter is provided between said vent and said developer container.

3. A cartridge according to claim 1, wherein both said hollow portion and said filter are substantially cylindrical.

4. A cartridge according to claim 3, wherein the diameter of said filter before it is inserted into said hollow portion is larger than the inner diameter of said hollow portion.

5. A cartridge according to claim 3, wherein the height of said filter before it is inserted into said hollow portion is larger than the depth of said hollow portion.

6. A cartridge according to claim 3, wherein the height of said filter before it is inserted into said hollow portion is larger than the diameter of said filter.

7. A cartridge according to claim 1, wherein said filter does not adhere to said hollow portion.

8. A cartridge according to claim 1, wherein said filter permits passage of air and blocks passage of a developer.

9. A cartridge according to claim 1, wherein said filter is a foam member.

10. A cartridge according to claim 1, wherein said developer container is composed of superposed first and second frames, said hollow portion is provided on said second frame, and said first frame prevents said filter from coming off from said hollow portion.

11. A cartridge according to claim 1, wherein said developer container is composed of superimposed first and second frames, said hollow portion is provided on said second frame, and said first frame compresses said filter inserted into said hollow portion.

12. A cartridge according to claims 10 or 11, wherein said pressure regulating means is provided on a flange portion of said second frame.

13. A cartridge according to claims 10 or 11, wherein said first frame and said second frame are connected with each other by a welded portion at which respective flange portions of said first and second frames are welded together, and wherein said pressure regulating means is provided between a developer containing portion and the welded portion.

14. A cartridge according to claim 1, further comprising a developer bearing member configured to bear and move a developer.

15. A cartridge according to claim 14, further comprising an image bearing member configured and positioned to receive a supply of the developer from said developer bearing member.

16. A cartridge according to claim 15, wherein said image bearing member has a photosensitive member.

17. A cartridge detachably mountable to an image forming apparatus, comprising:

a developer container, said container including a first frame and a second frame, wherein said container is formed by connecting a flange portion of said first frame and a flange portion of said second frame; and pressure regulating means, provided on said flange portion of said second frame, for regulating air pressure in said developer container, wherein said pressure regulating means includes a hollow portion having a vent and a filter being disposed in said hollow portion, and wherein said flange portion of said first frame prevents said filter from coming off from said hollow portion.

18. A cartridge according to claim 17, wherein said filter is provided between said vent and said developer container.

19. A cartridge according to claim 17, wherein said filter does not adhere to said hollow portion.

20. A cartridge according to claim 17, wherein said filter permits passage of air and blocks passage of a developer.

21. A cartridge according to claim 17, wherein said filter is a foam member.

22. A cartridge according to claim 17, wherein said first frame and said second frame are connected with each other by a welded portion at which respective flange portions of said first and second frames are welded together, and wherein said pressure regulating means is provided between a developer containing portion and the welded portion.

23. A cartridge according to claim 17, further comprising a developer bearing member configured to bear and move a developer.

24. A cartridge according to claim 23, further comprising an image bearing member configured and positioned to receive a supply of the developer from said developer bearing member.

25. A cartridge according to claim 24, wherein said image bearing member has a photosensitive member.

* * * * *

UNITED STATES PATENT AND TRADEMARK OFFICE

CERTIFICATE OF CORRECTION

PATENT NO. : 6,701,106 B2
DATED : March 2, 2004
INVENTOR(S) : Akiyoshi Yokoi et al.

It is certified that error appears in the above-identified patent and that said Letters Patent is hereby corrected as shown below:

Column 8,
Line 1, “angle o” should read -- angle θ --.

Column 9,
Line 16, “directions,” should read -- direction, --.
Line 34, “is” should read -- are --.

Column 10,
Line 55, “20” should be deleted.
Line 60, “25” should be deleted.

Column 12,
Line 34, “portion 10A,” should read -- portion 100A, --.

Signed and Sealed this

Thirteenth Day of July, 2004

JON W. DUDAS
*Acting Director of the United States Patent and Trademark Office*